US005200673A

United States Patent [19]

Hishiki

[11] Patent Number: 5,200,673

[45] Date of Patent: Apr. 6, 1993

[54] METHOD AND DEVICE FOR SUPPRESSION OF LEAKAGE OF MAGNETIC FLUX IN DISPLAY APPARATUS

[75] Inventor: Hideo Hishiki, Iwai, Japan

[73] Assignee: Victor Company of Japan, Ltd., Yokohama, Japan

[21] Appl. No.: 819,630

[22] Filed: Jan. 10, 1992

Related U.S. Application Data

[63] Continuation of Ser. No. 663,059, Feb. 27, 1991, abandoned, which is a continuation of Ser. No. 430,620, Oct. 31, 1989, abandoned.

[30] Foreign Application Priority Data

Oct. 31, 1988 [JP] Japan ..... 63-274672

[51] Int. Cl.[5] ..... H01J 29/56

[52] U.S. Cl. ..... 315/370; 315/8

[58] Field of Search ..... 315/370, 399, 8

[56] References Cited

U.S. PATENT DOCUMENTS

| | | | |
|---|---|---|---|
| 4,316,119 | 2/1982 | Cooper | 315/8 |
| 4,700,260 | 10/1987 | Craig et al. | 315/8 |
| 4,857,805 | 8/1989 | Bosch et al. | 315/370 |

FOREIGN PATENT DOCUMENTS

| | | |
|---|---|---|
| 0220777 | 5/1987 | European Pat. Off. . |
| 89306338.8 | 6/1988 | European Pat. Off. . |
| 62-223952 | 10/1987 | Japan . |
| 63-13245 | 1/1988 | Japan . |
| 63-156411 | 6/1988 | Japan . |
| 87/05437 | 9/1987 | World Int. Prop. O. . |

*Primary Examiner*—Theodore M. Blum

*Attorney, Agent, or Firm*—Jacobson, Price, Holman & Stern

[57] ABSTRACT

A device for suppression of leakage of the magnetic flux in a cathode ray tube display apparatus which comprises at least a cathode ray tube having a face plate and horizontal beam deflection circuit generating the leakage, the deflection circuit comprising a pair of upper and lower coils each of which has a bend-up section producing a first magnetic field which deflects an electron beam of the cathode ray tube, and a second magnetic field produced as the leakage the first and second magnetic field forming a boundary plane therebetween, so that two boundary planes are formed of said upper and lower deflection coils, respectively, said device comprising; a pair of conductors each of which has a main portion and a lead portion connected to the main portion, said main portion of the pair of conductors being disposed approximately within said boundary plane and along approximately top and bottom rims of the face plate, respectively, said lead portion of the pair of conductors disposed along a side wall of a funnel of the cathode ray tube in such a form that one end of the lead portion is bent along a side rim of the face plate to couple with said main portion and another end of the lead portion extends toward a rear of the horizontal beam deflector, the pair of conductors being driven with a current proportional to a horizontal deflection current flowing through the horizontal beam deflectors.

9 Claims, 13 Drawing Sheets

| ITEMS \ SYSTEMS | SYSTEM I FIG. 1A | | SYSTEM II FIG. 1C | | SYSTEM III FIG. 1B | | SYSTEM IV FIG. 2 | | NONE OF CANCEL | |
|---|---|---|---|---|---|---|---|---|---|---|
| | MAXI-MUM | MINI-MUM | MAXI-MUM | MINI-MUM | MAXI-MUM | MINI-MUM | MAXI-MUM | MINI-MUM | MAXI-MUM | MINI-MUM |
| CHANGED DEGREE OF MAGNETIC FIELD(mT/sec) | 203 | 49 | 53 | 34 | 55 | 27 | 63 | 30 | 71 | 43 |
| MAGNETIC FIELD STRENGTH (nT) | 384 | 103 | 93 | 58 | 93 | 46 | 126 | 60 | 122 | 75 |

FIG. 5
PRIOR ART

METHOD AND DEVICE FOR SUPPRESSION OF LEAKAGE OF MAGNETIC FLUX IN DISPLAY APPARATUS

This is a continuation of application Ser. No. 07/663,059, filed Feb. 27, 1991 which was abandoned upon the filing hereof; which in turn is a continuation of application Ser. No. 07/430,620, now abandoned, filed Oct. 31, 1989.

BACKGROUND OF THE INVENTION

This invention relates to a method and a device for suppression of leakage of magnetic flux in a cathode ray tube display apparatus, which is adapted to suppress leakage magnetic flux generated from the deflection yoke.

There are many display apparatuses of the type utilizing a magnetic field generated from the deflection coil, etc. as the method of deflecting an electron beam. For this reason, in the display apparatus of this kind, a magnetic flux from the deflection coil, etc. leaks out from the surrounding of the cathode ray tube. Such an unnecessary electromagnetic ray may exert bad or adverse influence on the operation of electronic equipment in the vicinity thereof.

Recently, studies on the influence exerted on the human being and animals of the magnetic field have been conducted. For example, a magnetic field from the cathode ray tube is considered to be also harmful. In view of this, the research institution of SSI (Statens Stralskydds Institut) in Sweden has announced that in regard to the super low frequency magnetic field, with the point within 15 cm from the center of the display surface of the cathode ray tube being as a center, as recommended values of the change rate, i.e., time-derivative (dB/dt) of a magnetic flux density at 80 positions positions on the spherical body having a radius of 65 cm and the strength of a magnetic flux density in the frequency band of 10 to 300 KHz, the change rate of the maximum magnetic field is set to a value lower than 25 mT (mili tesla), and the strength of the maximum magnetic flux density is set to a value lower than 50 nT (nano tesla).

In the above-described description, T represents Tesla which is the unit of the strength of a magnetic field, and 1 T=10000 Gauss and 1 mT=10 Gauss.

For allowing the change rate of a maximum magnetic field as the entirety of the display apparatus to satisfy the value lower than 25 mT/sec, it is indicated by the display manufacturers and sellers (e.g., IBM, etc.) that the change rate of the maximum magnetic field should be a value lower than 15 mT/sec as the standard requirement in the state of the cathode ray tube to which the deflection yoke is attached, i.e., the cathode ray tube display apparatus what is called an ITC (Integrated Tube Component).

For conventional technologies for suppression of leakage magnetic flux from the deflection yoke on the display surface of the cathode ray tube, there were two prior arts described below.

The first prior art is the technology shown in FIGS. 1A to 1C. This has been already filed at the Japanese Patent Office by N. V. Philips Gloellampenfabrieken (Japanese Patent Application Laid Open No. 223952/1987).

Namely, FIGS. 1A to 1C show examples where an electric wire 1 is electrically coupled to the deflection unit and the electric wire 1 is disposed on a face-plate 2, respectively. In these figures, reference numerals 3*a* and 3*b* represent ordinary connection terminals of the deflection unit, respectively.

In the case of the example of FIG. 4A (system I), the electric wire 1 is connected in series with deflection coils 4*a* and 4*b*, and two electric wire sections 1*a* and 1*b* in a horizontal direction of the electric wire are directly attached to the upper and lower side edge portions of the face-plate 2, or are attached in a manner that they are extremely close thereto, respectively.

In the case of the example of FIG. 1C (system II), for compensating a stray magnetic flux of individual deflection coils, a deflection coil 4*a* is coupled in series with the upper side electric wire section 1*a* in a horizontal direction, and a deflection coil 4*b* is coupled in series with the lower side electric wire section 1*b* in the horizontal direction.

In the case of the example of FIG. 1B (system III), a control current source 5 is disposed between the deflection coils 4*a* and 4*b* and the electric wire sections 1*a* and 1*b*. In this case, the electric wire sections are wound a plurality of times, i.e., as a plurality of loops at the upper and lower side edge portions of the faceplate 2.

The second technology has been proposed by the same assignee as one of this invention. (Japanese Patent Application No. 156411/1987, EPC Application No. 89306338.8).

Namely, the example shown in FIG. 2 (system IV) is as follows. In this figure, reference numeral 6 represents a cathode ray tube, reference numeral 7 a deflection coil, and reference numerals 8*a* and 8*b* electric wires for producing cancellation magnetic flux, respectively. The electric wires 8*a* and 8*b* are disposed in a manner that they are wound on the upper and lower halves around the display surface 10, respectively. A horizontal deflection current is delivered in a direction indicated by an arrow in the figure. The deflection coil 7 is provided in the vicinity of an electron gun 9 so that is deflects an electron beam. A horizontal deflection current is delivered from the deflection circuit to the deflection coil 7.

At this time, a signal from the deflection circuit is delivered to the deflection coil 7, and this signal is also delivered to the electric wires 8*a* and 8*b*, and varies in synchronism with the signal flowing in the deflection coil 7.

The leakage magnetic flux was measured under the following condition in connection with the systems I to IV according to the above-described first and second prior arts.

For measuring the recommendated value announced by the above SSI in Sweden, a meter (MAGNETIC FIELD METER MODEL MFM 1000) capable of measuring a low frequency leakage magnetic field developed by Combinova Company in Sweden is used. An actual measurement was conducted as follows. As shown in FIG. 3, antennas corresponding to magnetic fields from three directions were installed at positions of A, C and E. The CRT display apparatus was then rotated clockwise and anticlockwise using the central point of the display apparatus as a center. The change rate of the magnetic field and the strength of the magnetic field under the condition in FIGS. 3 and 4 (particularly at positions and angles of the antenna relative to the cathode ray tube), i.e., at the positions where antennas are installed, labelled A0, A1, A2, A14, A15, C0, C1, C2, C14, C15, E0, E1, E2, E14, E15, are measured by allowing a sawtooth current 7.8 A p-p having a horizontal deflection frequency of 20 KHz to flow in a horizontal deflection coil (not shown) of the deflection yoke 12 of the cathode ray tube 11, and by allowing a sawtooth current having a vertical deflection frequency of 60 Hz to flow in a vertical deflection coil (not shown).

As a result, the maximum values and the minimum values of measured values at 15 positions in accordance with the above-described systems I to IV are as shown in FIG. 5.

All the measured values shown in this figure vary to much extent depending upon the wiring position of a lead wire for conducting a current into the electric wire for cancellation of leakage magnetic flux provided in the vicinity of the face-plate of the cathode ray tube. By changing the wiring position of the lead wire, a value at a specific position on the above-mentioned electric wire may be minimized. However, if measurement is made with the lead wire in the above-described first and second prior arts hanging down in a direction of gravity, it was impossible to minimize, in a well-balanced manner, measured values on the measurement spherical body constituted by the above-described 15 positions. Further, cathode ray tube display apparatus could be hardly mass-produced in such an unbalanced state.

Meanwhile, when, as in the above-described arrangement shown in FIGS. 1A and 1B, two electric wire sections 1*a* and 1*b* for cancellation of leakage magnetic flux along the upper and lower side edge portions of the face-plate 2 are connected by electric wires indicated by broken lines, which are subjected to wiring on the diagonal line, a magnetic flux in the same direction as that of a magnetic flux (leakage flux) produced form the deflection coils 4*a*, 4*b* is produced across the electric wire on the diagonal line. Not only the leakage magnetic flux cancellation effect by the electric wire sections 1*a* and 1*b* can be reduced, but also it could not be expected to uniformly exhibit the leakage magnetic flux cancellation effect on the above-described spherical body designated by the SSI institution.

Further, also in the arrangement shown in FIG. 1C, a magnetic flux generated form the electric wire indicated by broken lines becomes effective in a direction of decreasing the leakage magnetic flux cancellation effect. Thus, a sufficient effect could not be expected.

Furthermore, in the above-described second prior art (EPC Appln. No. 89306338.8), it is suggested that the source from which a leakage magnetic flux is produced in front of the display surface of the cathode ray tube is a bend-up portion of the horizontal deflection coil.

However, as shown in FIG. 8 which will be described later, how an actual leakage magnetic flux is produced is such that leakage magnetic flux $B_{2b}$ radiated in a forward direction of the fluorescent display surface 53*a* is extremely greater than the magnetic flux $B_1$ produced form the bend-up portions $\mathbf{50}_{a1}$ and $\mathbf{50}_{b1}$ of the horizontal deflection coils 50*a* and 50*b*. Thus, it is necessary to produce a cancellation magnetic flux in a direction opposite to that of the second prior art.

When a leakage magnetic flux cancellation magnetic flux is produced in a direction as indicated by the patent specification according to the above-described second prior art, a far greater leakage magnetic flux would be produced as compared to the case where there is no electric wire for cancellation of leakage magnetic flux.

In addition, as shown in FIGS. 11, 12 and 17 which will be described later, a leakage magnetic flux $B_{2c}$ in the same direction as that of the main magnetic flux $B_{2a}$ component is produced also from the side surface portions of the cathode ray tube or the side surface portions of the deflection yoke. Since this leakage magnetic flux $B_{2c}$ exerts an effect also in the forward direction of the display surface, unless such a leakage magnetic flux $B_{2c}$ is canceled along with other leakage magnetic flux, the leakage magnetic flux of the entirety of the cathode ray tube display apparatus cannot be reduced to a low level. Particularly cancellation of the leakage magnetic flux $B_{2c}$ toward the side surfaces could not be imagined by the prior art.

Accordingly, none of the above-described prior arts can reduce the strength of an unnecessary magnetic flux over the entire periphery of the cathode ray tube, and manufacture apparatus which can satisfy the standard requirement of recent display manufacturers and sellers. Thus, it was necessary to stably reduce the leakage magnetic flux radiated from the cathode ray tube display apparatus and to allow the value of the leakage magnetic flux to fall within the above-mentioned recommended value.

SUMMARY OF THE INVENTION

This invention has been made in view of the above, and its object is to provide a method and a device for suppression of leakage of magnetic flux in a cathode ray tube display apparatus, which can satisfy the standard requirements of display manufacturers and sellers.

Namely, the object of this invention is to provide a method and a device for suppression of leakage of magnetic flux, which prevents that a magnetic flux in a specific direction around CRT, and which is capable of reducing, efficiently and to such an extent having no serious harmful influence on the human body, a leakage magnetic flux produced form CRT, having a bad influence on other equipment and harmful to the human body.

To achieve the above object, a device for suppression of leakage of magnetic flux according to this invention is, in a CRT display apparatus comprising a CRT, a deflection yoke at the neck portion of the CRT, and a face-plate portion for holding the display surface of CRT, characterized in that an electric wire for suppression of leakage magnetic flux is constituted by a first upper electric wire portion and a second lower electric wire portion arranged at positions as close as possible to the display surface at the upper and lower edges of the face-plate portion and bent slightly toward the inside of four corner portions, and first and second four lead wire portions disposed extending to the central portion of the both side surfaces of the deflection yoke from the position where the first and second electric wires are bent and gradually coming close in proportion to the distance from the rear portion of the CRT so as to gather at the neck portion on the both side surfaces of the CRT; and in that, in order to suppress a main deflection magnetic flux leaking out from the front surface of the face-plate, a current in a direction for canceling the main magnetic flux is delivered to the first and second electric wire portions, and a current in the same direction as that of a horizontal deflection current for producing the main magnetic flux is delivered to the first and second lead wire portions.

More particularly, in order to solve the above-described problems, this invention provides a method and a device for suppression of leakage of magnetic flux in a cathode ray tube display apparatus as featured below.

First, there is proposed a method for suppression of leakage of magnetic flux in a cathode ray tube display apparatus, the method comprising the steps of:

arranging first and second electric wires at the upper and lower side edge portions of a face-plate portion as close as possible to the display surface in the vicinity of the boundary surface between a main deflection magnetic flux produced from a horizontal deflection coil of a deflection yoke in a cathode ray tube display apparatus provided with a cathode ray tube, the deflection yoke attached at the neck portion of the cathode ray tube, the face-plate portion for holding the display surface, and a funneled portion, and a magnetic flux radiating from the forward direction of the display surface and produced from the bend-up portion of the horizontal deflection coil, arranging and bending the first and second electric wires in the vicinity of the boundary plane between the main deflection magnetic flux radiating toward the both left and right side wall portions of the face-plate portion and the magnetic flux produced from the bend-up portion of the horizontal deflection coil between respective corner portions of the face-plate portion and the portions in the vicinity of the left and right side wall portions of the face-plate portion intersecting with the horizontal plane of the cathode ray tube, in arranging first and second lead portions contiguous to the first and second electric wires from the both left and right sides wall portions of the face-plate portion toward the portion in the vicinity of the neck portion side of the horizontal deflection coil, arranging the first and second lead portions so that a spacing between the first and second lead portions gradually becomes small, between the portion in the vicinity of a boundary plane and the horizontal plane, the boundary plane being formed between the main deflection magnetic flux radiating toward the side wall portions of the deflection yoke, a leakage magnetic flux component of the main deflection magnetic flux, and a magnetic flux produced from the bend-up portion of the horizontal deflection coil, delivering, into the first and second lead wires, a current having a magnetic flux in the same direction as that of the horizontal deflection current delivered to the horizontal deflection coil, and canceling, by the first and second electric wires and the first and second lead portions, a leakage magnetic flux radiated from the cathode ray tube display apparatus with the deflection yoke attached thereto over the entire surrounding of the cathode ray tube.

Secondly, there is proposed a device for suppression of leakage of magnetic flux in a cathode ray tube display apparatus, the device comprising:

first and second electric wires arranged at the upper and lower edge portions and the both left and right side wall portions of a face-plate portion as close as possible to the display surface in the vicinity of the boundary plane between a main deflection magnetic flux produced from a horizontal deflection coil of the defection yoke in a cathode ray tube display apparatus provided with a cathode ray tube, the deflection yoke attached at the neck portion of the cathode ray tube, the face-plate portion for holding the display surface, and a funneled portion, and a magnetic flux radiating from the forwarding direction of the display surface and produced from the bend-up portion of the horizontal deflection coil, and arranged and bent up to the portion in the vicinity of the boundary plane between the main deflection magnetic flux radiating toward the both left and right side walls of the face-plate portion and a magnetic flux produced form the bend-up portion of type horizontal deflection coil, between respective corner portions of the face-plate portion and the horizontal plane of the cathode ray tube, respectively; and first and second lead portions contiguous to the respective first and second electric wires, and arranged, when they are arranged form the bent portion of the both left and right side walls of the face-plate portion toward the portion in the vicinity of a terminal on the neck portion side of the horizontal deflection coil, through the horizontal plane, along the boundary plane between the main deflection magnetic flux radiated toward the side walls of the deflection yoke and the funneled portion, a leakage magnetic flux, and the magnetic flux produced from the bend-up portion of the horizontal deflection coil so that a spacing between the first and second lead portions gradually becomes small, a current having the same direction of a magnetic flux as that of the horizontal deflection current delivered to the horizontal deflection coil being delivered to the first and second lead portions;

a leakage magnetic flux radiated from the cathode ray tube display apparatus with the deflection yoke attached thereto being canceled over the entire surrounding of the cathode ray tube by the first and second electric wires and the first and second lead portions;

thirdly, there is proposed a device for suppression of leakage of magnetic flux in a cathode ray tube display apparatus, the device comprising:

first and second electric wires arranged at the upper and lower edge portions and the both left and right side walls of a face-plate portions as close as possible to the display surface in the vicinity of the boundary plane between a main deflection magnetic flux produced from a horizontal deflection coil of the deflection yoke in a cathode ray tube display apparatus provided with a cathode ray tube, the deflection yoke attached at the neck portion of the cathode ray tue, and face-plate portion for holding the display surface, and a funneled portion and a magnetic flux radiating from the forwarding direction of the display surface and produced from the bend-up portion of the horizontal deflection coil, and arranged and bent at the both left and right both side walls of the face-plate portion in the vicinity of substantially the intermedium portion of respective corner portions of the face-plate portion and the horizontal plane of the cathode ray tube, respectively; and first and second lead portions contiguous to the respective first and second electric wires, and arranged; when they are arranged from the both left and right side walls of the face-plate portion toward the horizontal deflection coil, through the horizontal plane, so that a spacing between the first and second lead portions gradually becomes small to reach zero, a current having the same direction of a magnetic flux as that of the horizontal deflection current delivered to the horizontal deflection coil being delivered to the first and second lead portions;

a leakage magnetic flux radiated from the cathode ray tube display apparatus with the deflection yoke attached thereto being canceled over the entire surrounding of the cathode ray tube by the first and second electric wires and the first and second lead portions.

Fourthly, there is proposed a device for suppression of leakage of magnetic flux in a cathode ray tube display apparatus, the device comprising:

first and second electric wires arranged at the upper and lower edge portions and the both left and right side walls of a face-plate portion as close as possible to the display surface in the vicinity of the boundary plane between a main deflection magnetic flux produced from a horizontal deflection coil of the deflection yoke in a cathode ray tube display apparatus provided with a cathode ray tube, the deflection yoke attached at the neck portion of the cathode ray tube, face-plate portion for holding the display surface, and a funneled portion, and a magnetic flux radiating from the forwarding direction of the display surface and produced from the bend-up portion of the horizontal deflection coil, and arranged in the vicinity of the both left and right side walls of the face-plate portion intersecting with the horizontal plane of the cathode ray tube from the respective corner portions of the face-plate portion, respectively; and first and second lead portions contiguous to the respective first and second electric wires, and arranged, so that they are opposite to each other from the both left and right side walls of the face-plate toward the horizontal deflection coil, a current having the same direction of a magnetic flux as that of the horizontal deflection coil being delivered to the first and second lead wires;

a leakage magnetic flux radiated from the cathode ray tube display apparatus with the deflection yoke attached thereto being canceled over the entire surrounding of the cathode ray tube by the first and second electric wires and the first and second lead portions.

Fifthly, there is proposed a device for suppression of leakage of magnetic flux in a cathode ray tube display apparatus, the device comprising:

a demagnetization coil attached on a funneled portion in a cathode ray tube display apparatus provided with a cathode ray tube, a deflection yoke attached at the neck portion of the cathode ray tube, and a face-plate portion of the cathode ray tube, and a face-plate portion for holding the display surface, a funneled portion, and for carrying out demagnetization of a shadow mask, etc., first and second electric wires attached at the both ends thereof to the magnetization coil, arranged at the upper and lower edge portions of the face-plate portion as close as possible to the display surface, and arranged and extended to respective corner portions of the face-plate portion, first and lead wires contiguous to the respective first and second electric wires, and arranged so that they are opposite to each other substantially along the horizontal plane of the cathode ray tube from the both left and right side walls of the face-plate portion toward the horizontal deflection coil of the deflection yoke, a current having the same direction of a magnetic flux as that of a horizontal deflection current delivered to the horizontal deflection coil being delivered to the first and second lead wires, a leakage magnetic flux irradiated from the cathode ray tube display apparatus with the deflection yoke attached thereto being canceled over the entire surrounding of the cathode ray tube by the first and second electric wires and the first and second lead portions.

Sixthly, there is proposed a device for suppression of leakage of magnetic flux in a cathode ray tube display apparatus, the device comprising:

a demagnetization coil attached on a funneled portion in a cathode ray tube display apparatus provided with a cathode ray tube, a deflection yoke attached at the neck portion of the cathode ray tube, a face-plate portion for holding the display surface, and a funneled portion, and for carrying out demagnetization of a shadow mask, etc., first and second electric wires attached at the both ends thereof to the magnetization coil, arranged at the upper and lower edge portions of the face-plate portion as close as possible to the display surface, and arranged and bent at the both left and right side walls of the face-plate portion in the vicinity of substantially the intermediate portion of the respective corner portions of the face-plate portion and the horizontal plane of the cathode ray tube, respectively, and first and second lead wires contiguous to the respective first and second electric wires, arranged, when they are arranged from the both left and right side walls of the face-plate portion toward a horizontal deflection coil of the deflection yoke, through the horizontal plane so that a spacing between the both lead wires gradually becomes small to reach zero, a current having the same direction of a magnetic flux as that of a horizontal deflection current delivered to the horizontal deflection coil being delivered to the first and second lead portions, a leakage magnetic flux irradiated from the cathode ray tube display apparatus with the deflection yoke attached thereto being canceled over the entire surrounding of the cathode ray tube by the first and second electric wires and the first and second lead portions.

As described above, in accordance with this invention, electric wires and lead portions contiguous thereto for producing a cancellation magnetic flux for canceling a leakage magnetic flux from the deflection coil are arranged on the upper and lower surfaces, and left and right side surfaces of the face-plate near the fluorescent display screen surface of the cathode ray tube, the side wall of the cathode ray tube, and the side surfaces of the deflection yoke, thus allowing a current in the same direction as that of a current flowing in the horizontal deflection coil to flow in the electric wires and the lead portions. Thus, the advantages are provided as follows. The strength and the change rate of a magnetic flux from the side surfaces of the cathode ray tube and/or the fluorescent display screen surface can be reduced to much extent over the entire surrounding of the cathode ray tube display apparatus. Further, interference with other equipment and/or influence on the human body can be reduced. In addition, by arranging, on the demagnetization coil, an electric wire for canceling a leakage magnetic flux, labor in attaching an electric wire independent of the demagnetization coil is saved, and positioning for such an attachment working or fixing of the electric wire is facilitated.

BRIEF DESCRIPTION OF THE DRAWINGS

In the accompanying drawings:

FIG. 5 is a Table collectively showing measured values obtained by the measurement methods shown in FIGS. 3 and 4;

DETAILED DESCRIPTION OF THE PREFERRED EMBODIMENTS

Preferred embodiments of a method and a device for suppression of leakage of magnetic flux in a cathode ray tube display apparatus will be described in conjunction with FIGS. 6 to 19, respectively.

The outline of the method and the device for suppression of leakage of magnetic flux in a cathode ray tube display apparatus will be seen particularly by making reference to a first embodiment of a device according to this invention.

Figure 6:
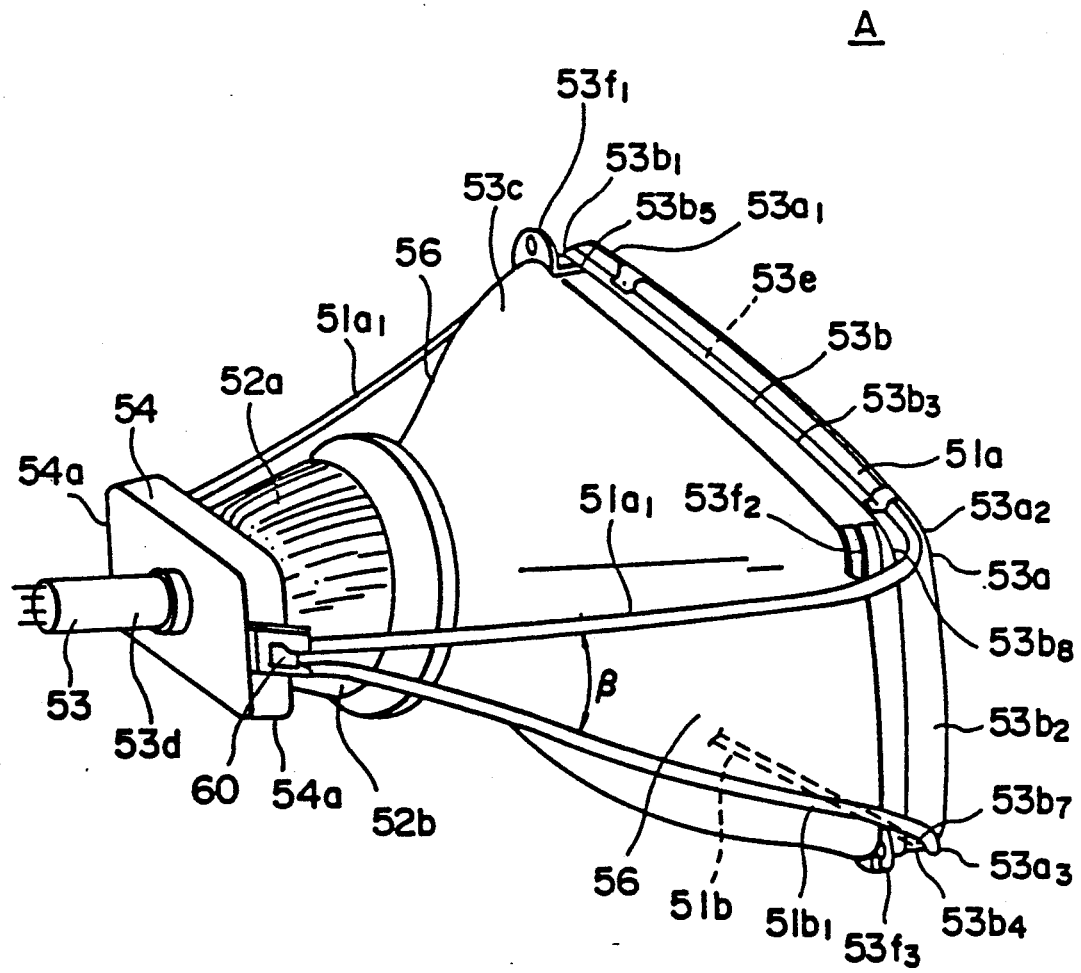
FIG. 6 is a perspective view showing a device of a first embodiment according to this invention attached to a cathode ray tube display apparatus.

Accordingly, attention is first to FIG. 6 showing the state where the device of the first embodiment is attached to a cathode ray tube display apparatus.

As shown in this figure, the outline of the cathode ray tube display apparatus A is composed of a cathode ray tube 53 including a fluorescent display screen surface 53*a*, a funneled portion 53*c*, a neck portion 53*d*, and a side wall 56, and a deflection yoke 54 having a horizontal deflection coil (not shown) attached to the neck proton 53*d*.

Further, electric wires 51*a*, 51*b* and four lead portions $51_{a1}$, $51_{a1}$, $51_{b1}$, $51_{b1}$ contiguous thereto for producing a magnetic flux for canceling a leakage magnetic flux are added to the side wall 56 of the cathode ray tube 53 and the upper and lower side edge portions $53_{b3}$, $53_{b4}$ of the plate portion $53_b$. The both ends of $51_{a1}$, $51_{b1}$ are connected to connection portions 60, 60 of the deflection yoke 54 along the portion in the vicinity of the side walls 56, 56.

In FIG. 6, four metal fittings $53_{f1}$, $53_{f4}$, $53_{f3}$ and $53_{f2}$ are affixed on four corner portions $53_{b5}$, $53_{b6}$, $53_{b7}$ and $53_{b8}$ of the face-plate portion $53_b$ of the cathode ray tube 53, respectively. Further, electric wires 51*a* and 51*b* are arranged in the vicinity of the fluorescent display screen surface 53*a* along the upper and lower side edge portions $53_{b3}$ and $53_{b4}$ of the face-plate portion 53*b* from the portion in the vicinity of the metal fittings $53_{f1}$ and $53_{f4}$ on one side surface portions $53_{b1}$ side of the face-plate portion 53*b* to the portion in the vicinity of the metal fittings $53_{f2}$ and $53_{f3}$ on the other side surface portion $53_{b2}$ side, and bent thereat.

Then, a pair of electric wires 51*a* and 51*b* are disposed approximately along top and bottom rims of the face-plate portion 53*b* and are contiguous to lead portions $51_{a1}$ and $51_{b1}$ and extended to terminal portion 60 which is located at a rear of the deflection yoke 54 and on a horizontal plane which is approximately perpendicular to the face-plate portion 53*b* and crosses horizontally the face-plate portion 53*b* at a vertical center thereof so that lead portions $51_{a1}$ and $51_{b1}$ progressively approach the horizontal plane toward the rear of the deflection yoke 54 along the side walls 56 and 56 of the funnel portions 53*c*, respectively. The lead portions $51_{a1}$ and $51_{b1}$ are bent along respective side rims of the face-plate portion 53*b* to couple with main portions of the electric wires 51*a* and 51*b*, which are located respectively at the top and bottom rims of the face-plate portion 53*b* as mentioned previously. Then, a current having a time function substantially corresponding to the time function of an electric wires 51*a* and 51*b* are contiguous to four lead wires $51_{a1}$, $51_{b1}$ and $51_{a1}$, $51_{b1}$ and electric wires 51*a* and 51*b* may be elongated by the length corresponding to these lead wires in place of using these lead wires according to need.

FIGS. 7A to 7D are circuit diagrams showing the state of connection between horizontal deflection coils 50*a*, 50*b* and electric portions 51*a*, 52*b* for producing a magnetic flux for canceling a leakage magnetic flux.

Figure 7A:
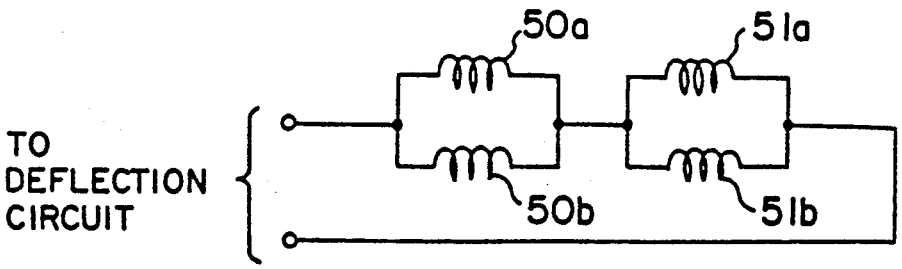
FIGS. 7A to 7D are circuit diagrams showing the states of connection between horizontal deflection coils 50*a*, 50*b* and electric wires 51*a*, 51*b* for producing a magnetic flux for canceling a leakage magnetic flux.

In the case of the connection shown in FIG. 7A, the above-mentioned electric portions 51*a*, 51*b* connected in parallel are cascade-connected to the horizontal deflection coils 50*a*, 50*b* connected in parallel constituting the defection yoke 54. As a modification thereof, connections shown in FIGS. 7B to 7D which will be described later may be employed.

Figure 7B:
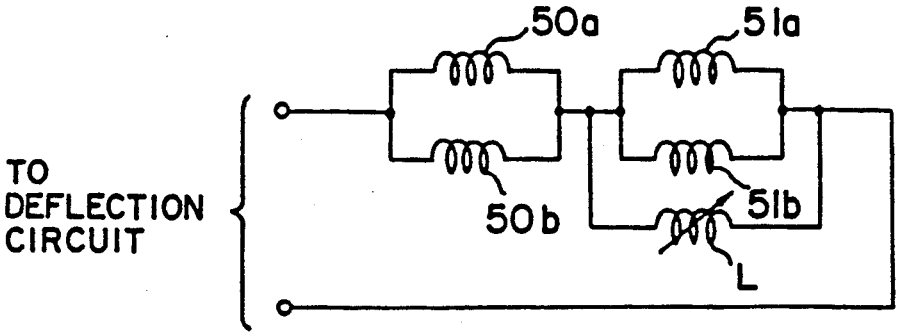

In the case of the connection shown in FIG. 7B, a variable or fixed inductance L is connected in parallel with the electric portions 51*a*, 51*b* connected in parallel. Further, in the case of the connection shown in FIG. 7C, a variable resistance R is connected thereto in place of the variable or fixed inductance L shown in FIG. 7B. In addition, in the case of the connection shown in FIG. 7D, electric portions 51*a*, 51*b* are connected to the succeeding stages of the horizontal deflection coils 50*a*, 50*b* connected in parallel.

In any of the circuit arrangements shown in FIGS. 7A to 7D, a current approximately proportional to the deflection current going through the horizontal deflection coils 50*a* and 50*b*, flows through the electric wires 51*a* and 51*b*. In FIGS. 7A to 7D, the horizontal deflection coils 50*a* and 50*b* may be connected each other in series, but it is possible to obtain the same effect, to therefore omit figures and description thereof.

Referring to FIGS. 8 to 11, there are shown distributions of magnetic flux produced in the state where the device of this invention attached to a cathode ray tube display apparatus is used.

Figure 8:
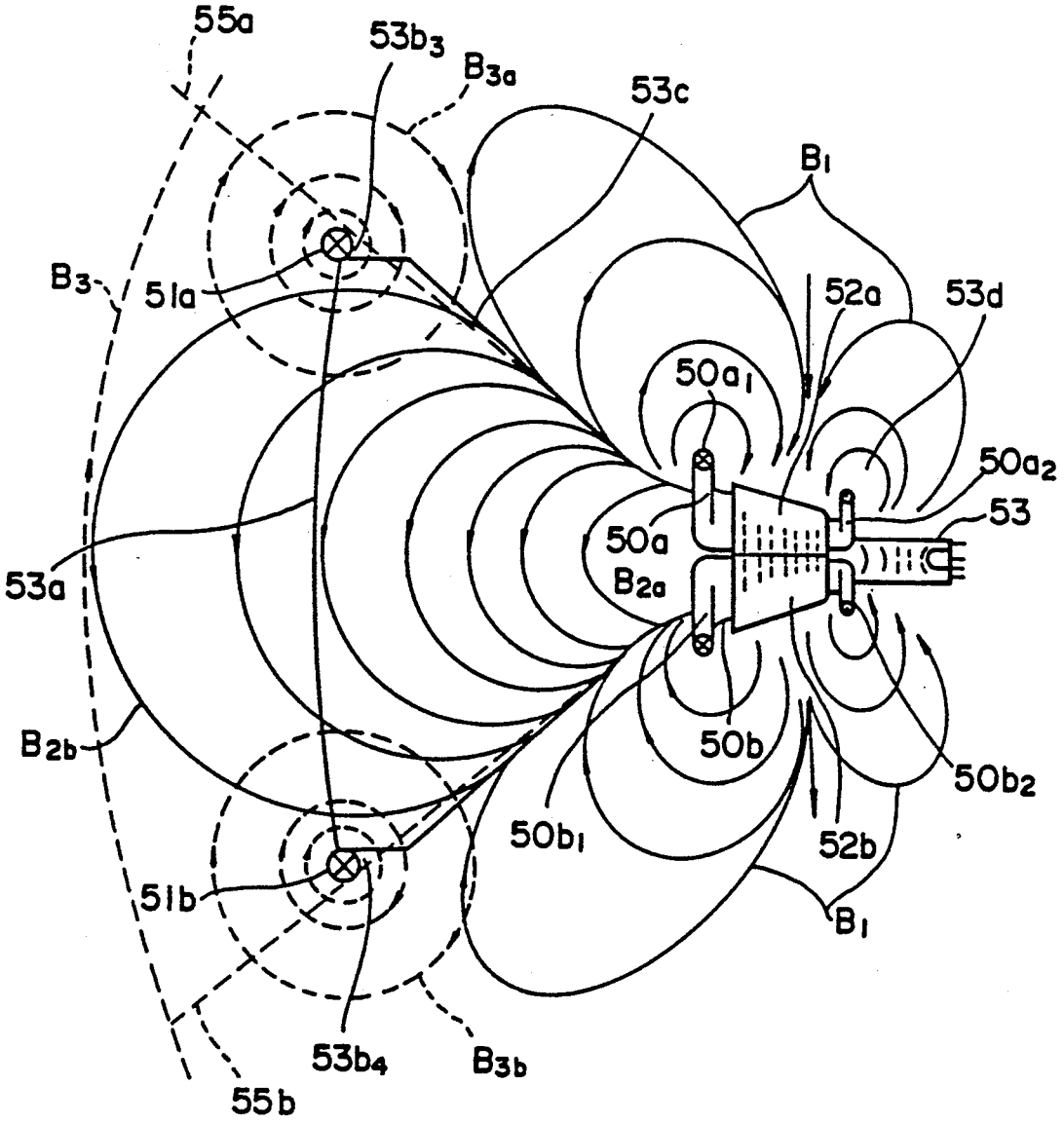
FIGS. 8 to 11 are diagrams showing the distributions of magnetic flux produced in the case where the device according to this invention attached to a cathode ray tube display apparatus is used, respectively.

As shown in FIG. 8, when a main magnetic flux (main deflection magnetic flux) $B_{2a}$ is produced on the horizontal deflection coils 50*a*, 50*b*, a partial magnetic flux $B_{2b}$ of the main magnetic flux $B_{2a}$ leaks out toward the outside from the fluorescent display screen surface 53*a*.

In FIG. 8, currents $I_{50a1}$, $I_{50b1}$, $I_{50a2}$, $I_{50b2}$ flow, in a direction indicated by the symbol representing the opposite side of the direction perpendicular to the plane of paper (ⓧ) or representing this side thereof ⊙, in the bend-up portions $50_{a1}$, $50_{b1}$ on the fluorescent display screen surface 53*a* of the horizontal deflection coils 50*a*, 50*b* and the bend-up portions $50_{a2}$, $50_{b2}$ on the neck portion 53*d* side opposite thereto. Thus, a leakage magnetic flux $B_1$ is produced.

Namely, as shown in FIG. 8, two boundary planes between the main magnetic flux $B_{2a}$ and the leakage magnetic flux $B_1$ exist substantially at the positions 55*a*, 55*b* indicated by broken lines (such boundary planes may exist on the display screen surface depending on the kind of the cathode ray tube).

Electric wires 51*a*, 51*b* are arranged in the vicinity of the two boundary planes 55*a* and 55*b* and at the upper and lower side edge portions $53_{b3}$, $53_{b4}$ of the face-plate portion 53*b* as close as possible to the fluorescent display screen surface 53*a*, respectively. When currents $I_{51a}$, $I_{51b}$ are caused to flow in these electric wires in directions shown in FIGS. 8 and 9, respectively, magnetic flux $B_{3a}$, $B_{3b}$ are produced therefrom.

These magnetic flux $B_{3a}$, $B_{3b}$ become active in a direction of canceling leakage magnetic flux $B_1$, $B_{2b}$ with respect to the direction located forward than the upper and lower outsides of the boundary planes 55*a*, 55*b* and the fluorescent display screen surface 53*a*.

Especially, leakage magnetic flux $B_{2b}$ radiated from the fluorescent display screen surface 53*a* toward the outside, and leakage magnetic flux $B_1$ radiated from the upper and lower side edge portions $53_{b3}$, $53_{b4}$ of the face-plate portion 53*b* and the upper and lower sides of the funneled portion 53*c* toward the outside can be suppressed.

Figure 12:
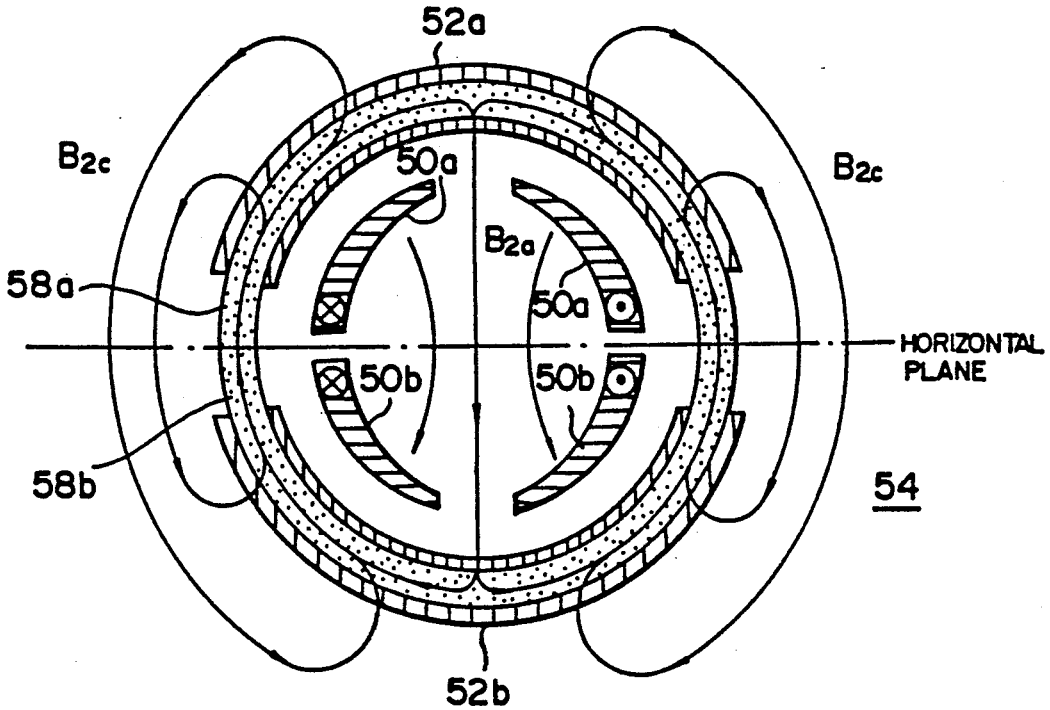
FIG. 12 is a diagram showing the distribution of magnetic flux of a deflection yoke produced in the case where the cathode ray tube display apparatus is in a use state.

On the other hand, as shown in FIG. 12, when a current is caused to flow in the horizontal deflection coils 50*a*, 50*b*, a main magnetic flux $B_{sa}$ is produced in the horizontal plane direction of the deflection yoke 54. A portion of the main magnetic flux $B_{2a}$ leaks out from the cores 58*a*, 58*b* of the deflection yoke toward the outside. Thus, a leakage magnetic flux $B_{2c}$ is produced.

Figure 9:
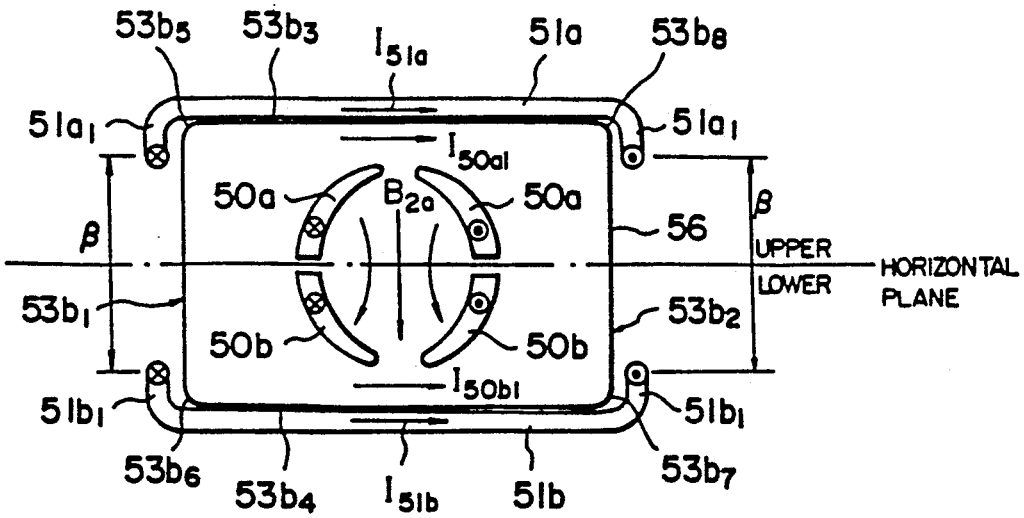
Figure 10:
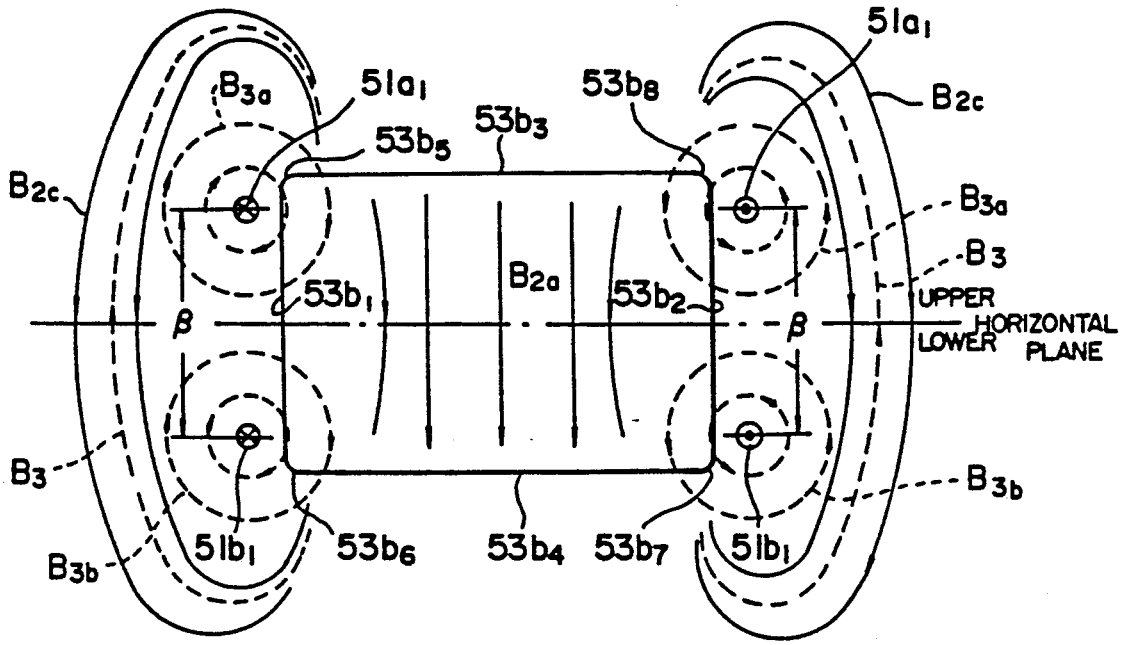
Figure 13:
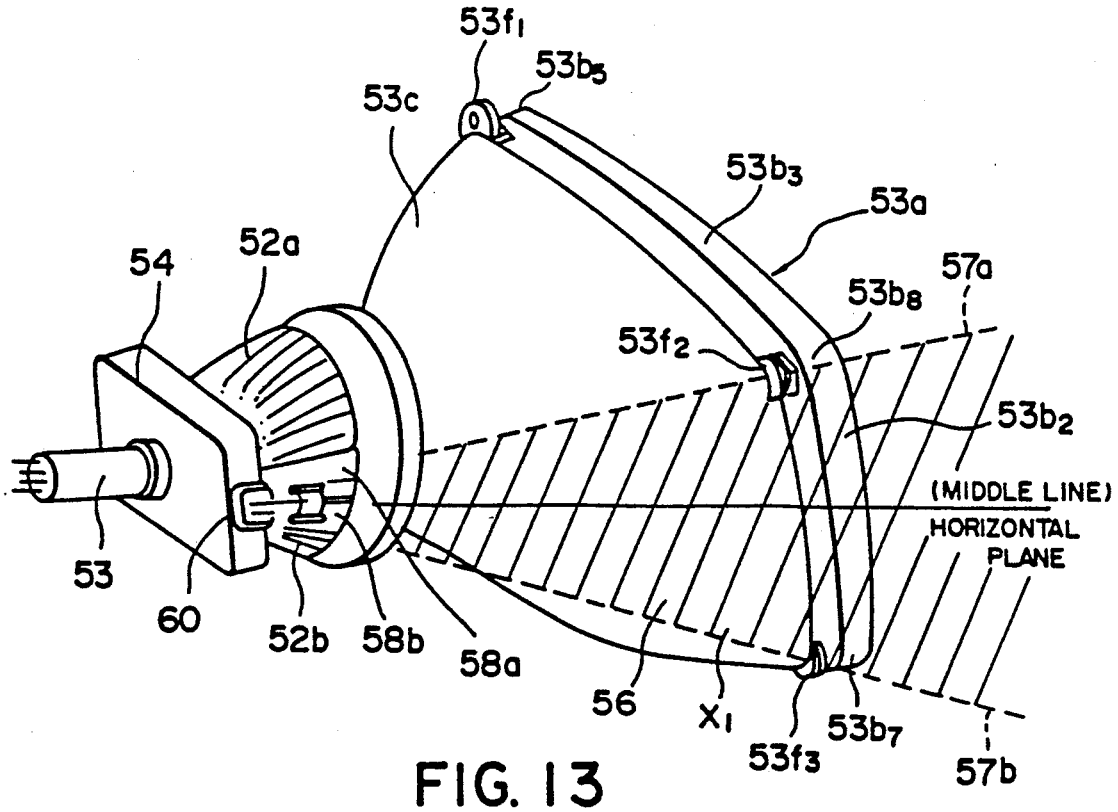
FIG. 13 is a rear perspective view showing a cathode ray tube display apparatus.

By the influence of the leakage magnetic flux $B_{2c}$, leakage magnetic flux $B_{2c}$ which is a portion of the main magnetic flux $B_{2a}$ is a portion of the main magnetic flux $B_{2a}$ is produced on the side wall 56 (x-axis plane) of the cathode ray tube 53 indicated by slanting lines in the rear perspective view of a cathode ray tube display apparatus shown in FIG. 13, i.e., between the corner portion $53_{b5}$ and the corner portion $53_{b6}$ of the face-plate portion between which the horizontal plane is present and between the corner portion $53_{b7}$ and the corner portions $53_{b8}$ thereof as shown in FIGS. 9 and 10.

The boundary surface between the leakage magnet flux $B_1$ and the leakage magnetic flux $B_{2c}$ exists substantially along the positions indicated by broken lines 57*a*, 57*b* shown in FIG. 13, i.e., four corner portions of the cathode ray tube 53 (i.e., four corner portions $53_{b5}$, $53_{b6}$, $53_{b7}$, $53_{b8}$ of the face-plate portion 53*b*).

Figure 11:
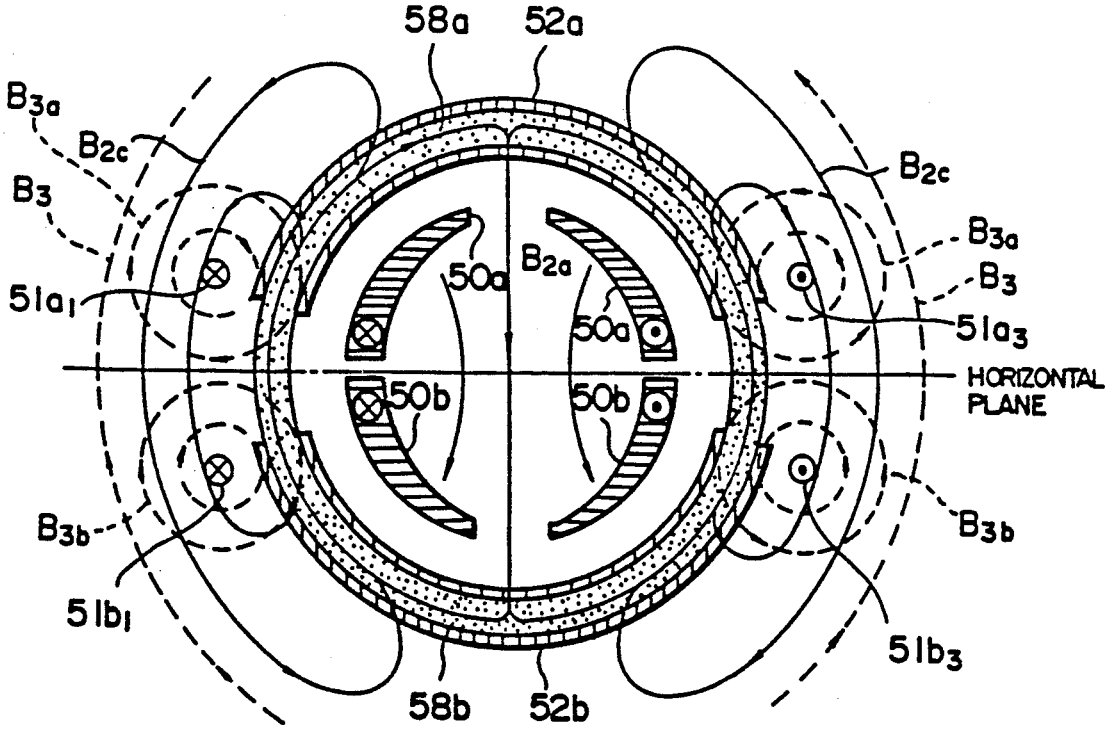

To cancel these leakage magnetic flux $B_1$, $B_{2c}$, as shown in FIGS. 10 and 11, four lead portions $51_{a1}$, $51_{b1}$, $51_{a1}$, $51_{b1}$ of the electric wires 51*a*, 51*b* in a manner that a spacing $\beta$ between respective lead wires is gradually widened at upward and downward positions on the horizontal plane according as the distance between the both left and right side surface portions $53_{b1}$, $53_{b2}$ of the face-plate portion 53*b* close to the fluorescent display screen surface 53*a* of the cathode ray tube 53 and the deflection yoke 54 decreases. When a current in a direction of the currents shown in FIGS. 10 and 11 is caused to flow, a magnetic flux $B_3$ is produced in a direction of canceling the magnetic flux $B_{2c}$.

Thus, leakage flux $B_{2c}$ radiated from the side surface portions of the deflection yoke 54 and/or the side wall 56 of the cathode ray tube 53 can be suppressed.

It is to be noted that if the spacing $\beta$ between lead portions $51_{a1}$ and $51_{b1}$ arranged at positions spaced from the side walls 56 of the cathode ray tube 53 at a predetermined interval is excessively widened as shown in FIG. 6, the leakage magnetic flux $B_{2c}$ becomes smaller than the cancellation magnetic flux $B_3$. As a result, the cancellation magnetic flux $B_3$ has an effect on the upper and lower portions of the boundary surfaces 57*a*, 57*b* between the leakage magnetic flux $B_{2c}$ and the leakage magnetic flux $B_1$, thus to strengthen the leakage magnetic flux at the upper and lower portions of the boundary surfaces 57*a*, 57*b*.

For this reason, as shown in FIG. 6, wiring of electric wires 51*a*, 51*b* and four lead portions $51_{a1}$, $51_{b1}$, $51_{a1}$, $51_{b1}$ is implemented in a manner that they pass from the side surface portion (near the horizontal plane) on the neck portion 54*d* side of the deflection yoke 54 through the corner portions $53_{a1}$ to $53_{a4}$ of the fluorescent display screen surface 53*a* of the cathode ray tube 53, i.e., the portions in the vicinity of the side surface portions 56, 56 of the four metal fittings $53_{f1}$, $53_{f4}$, $53_{f3}$, $53_{f2}$ provided on the four corner portions $53_{b5}$, $53_{b6}$, $53_{b8}$, of the face-plate 53*b*. By an employment of such a wiring, lead portions $51_{a1}$, $51_{b2}$ are located at positions closer to the horizontal plane side than the boundary lines 57*a*, 57*b*. Thus, leakage magnetic flux $B_{2c}$ can be stably suppressed, resulting in an improved leakage magnetic flux suppression effect.

Meanwhile, since the horizontal deflection coils 50*a*, 50*b* swing an electron beam (not shown) in a lateral direction of the cathode ray tube 53 as shown in FIG. 9, a main magnetic flux $B_{2a}$ is caused to be produced in a longitudinal direction perpendicular to the scanning direction (horizontal plane direction) of the electron beam. For this reason, horizontal deflection coils 50*a*, 50*b* are provided at the upper and lower positions on the horizontal plane of the cathode ray tube 53. Accordingly, the horizontal deflection coils 50*a*, 50*b* interchangeably produce, as magnetic flux $B_1$, $B_{a1}$, $B_{2b}$ produced therefrom, magnetic flux having directions opposite to the directions indicated by respective arrows shown in FIGS. 10 and 11 in correspondence with the horizontal deflection frequency.

Some research results teach that since a relatively large power is delivered to the horizontal deflection coils 50*a*, 50*b*, a leakage magnetic flux toward the external direction from the cathode ray tube as shown in FIG. 13 of the magnetic flux produced thereby is apt to interfere with other electronic equipment and a low frequency magnetic flux is harmful to the human body. The standard requirement for such phenomena is severe.

As stated above, the place where two electric wires 51*a*, 51*b* and four lead portions $51_{a1}$, $51_{b1}$, $51_{a1}$, $51_{b1}$ are attached is not limited to the cathode ray tube in this invention, but a leakage magnetic flux suppression device according to this invention may be attached to structure in the vicinity of the display screen surface 53*a* of the cathode ray tube 53, such as a cabinet for accommodating the cathode ray tube 53 so that a predetermined leakage magnetic flux suppression effect is provided. The object or place where the device according to this invention is attached is not limited.

Figure 14:
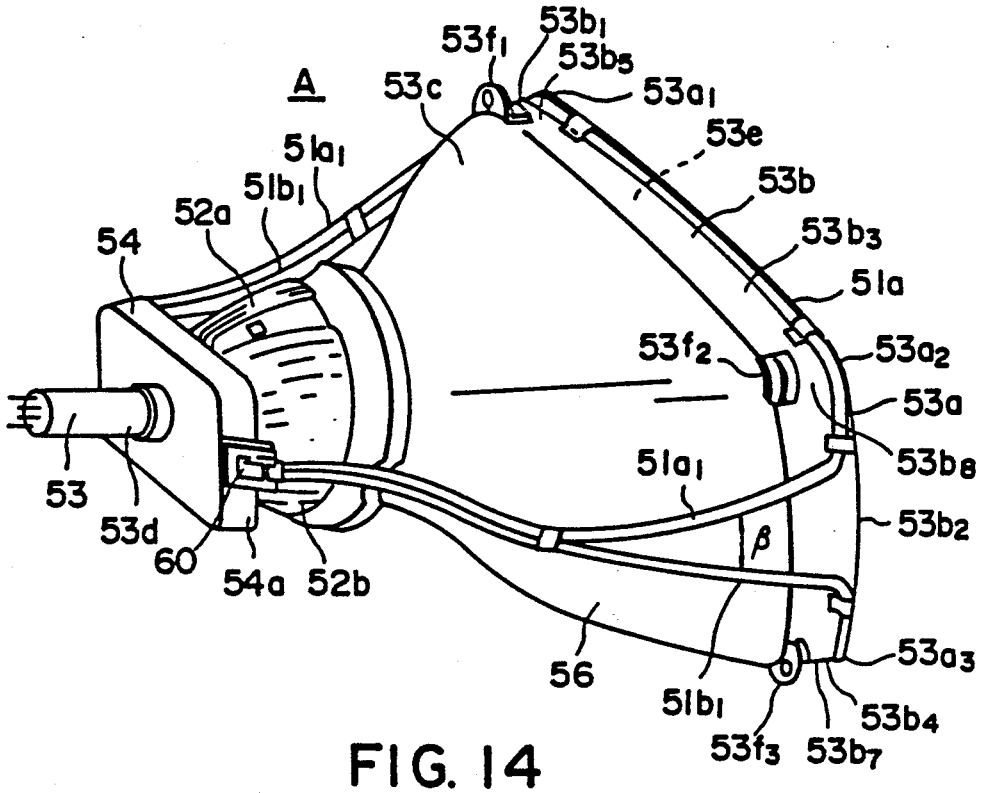
FIG. 14 and 15 are perspective views showing the state where devices of second and third embodiments according to this invention are attached to a cathode ray tube display apparatus, respectively.
Figure 15:
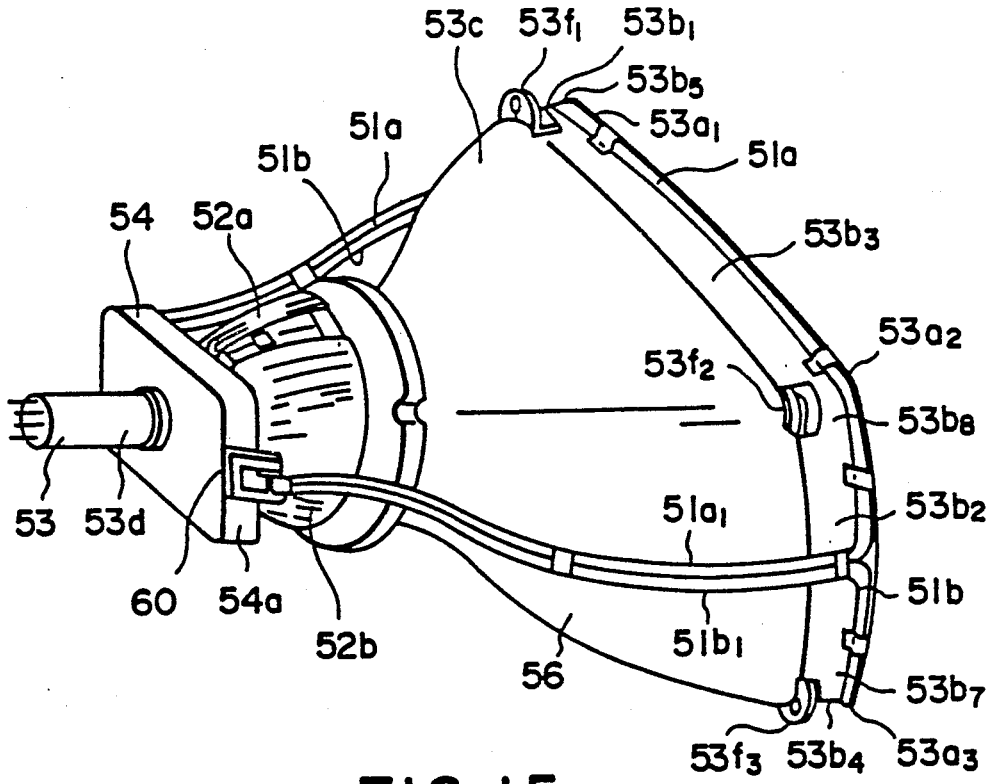

Referring to FIGS. 14 and 15, there are shown the state where the second and third embodiments of the devices according to this invention are attached to the cathode ray tube display device. The same components as those described above are designated by the same reference numerals, respectively, and their explanation will be omitted.

As shown in FIG. 14, the second embodiment of the device according to this invention is of substantially the same structure as the first embodiment shown in FIG. 6, but differs from the first embodiment in the following points.

Namely, in accordance with the device according to the second embodiment, one lead portion $51_{a1}$, $51_{b1}$ contiguous to electric portions 51*a*, 51*b* respectively arranged on the side walls 56, 56 of the cathode ray tube 53 are conducted, toward the side surface portion 54*a* of the deflection yoke 54, from substantially the intermediate portion of the side surface portion $53_{b1}$ of the face-plate 53*b* halved as a result of the fact that the line connecting the corner portions $53_{b5}$ and the corner portion $53_{b6}$ of the face-plate 53*b* and the horizontal plane extending from the deflection yoke 54 to the display screen surface 53*a* through the side surface portion $53_{b1}$ of the face-plate 53*b* intersect with each other. The other lead portions $51_{a1}$, $51_{b1}$ are conducted, toward the side surface portion 54*a* of the deflection yoke 54, substantially from the intermediate portion of the side surface portion $53_{b2}$ of the face-plate 53*b* halved as a result of the fact that the line connecting the corner portions $53_{b7}$ and the $53_{b8}$ of the face-plate 53*b* and the horizontal plane extending to the display screen surface 53*a* from the deflection yoke 54 through the side surface portion $53_{b2}$ of the face-plate 53*b* intersect with each other. Further, these lead portions $51_{a1}$, $51_{b1}$ are arranged in a manner that the spacing $\beta$ between lead portions $51_{a1}$ and $51_{b1}$ gradually becomes narrow from the left and right side surface portions $53_{b1}$, $53_{b2}$ of the face-plate 53*b* from substantially the intermediate portion of the length of respective lead portions $51_{a1}$, $51_{b1}$ extending to terminal portions 60, 60 of the deflection yoke 54, and are arranged in parallel so that they are adjacent to each other from the intermediate portion to the terminal portions 60, 60 of the deflection yoke 54.

As shown in FIG. 15, the third embodiment of the device according to this invention is of substantially the same structure as that of the above-described first embodiment shown in FIG. 6, but differs from the first embodiment in the following point.

The device according to the third embodiment is characterized in that even if the lead portions $51_{a1}$, $51_{b1}$ contiguous to electric portions 51*a*, 51*b* arranged on the side surface portion 56 of the cathode ray tube 53 become close to the fluorescent display screen surface 53*a*, the both lead wires are adjacent to each other.

Usually in a color cathode ray tube display apparatus, a demagnetizing coil is equipped around the CRT to prevent the shadow mask of the CRT from being magnetized by the earth magnetism. In such a type apparatus, abovementioned leakage flux cancelling wiring may be composed of the demagnetizing coil ad a body for supporting thereof.

Several embodiments of abovementioned type are shown in FIG. 16 to FIG. 19.

Figure 16:
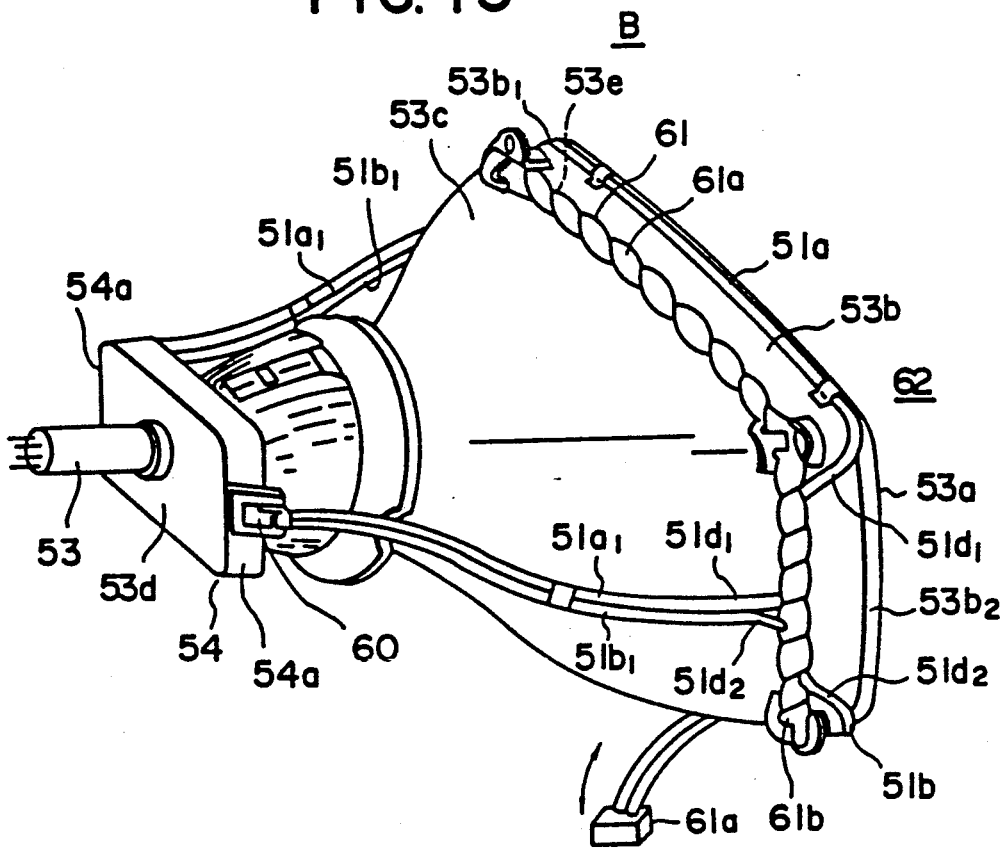
FIGS. 16 and 17 are perspective views showing the state where devices of fourth and fifth embodiments according to this invention are attached to a cathode ray tube display apparatus, respectively.
Figure 17:
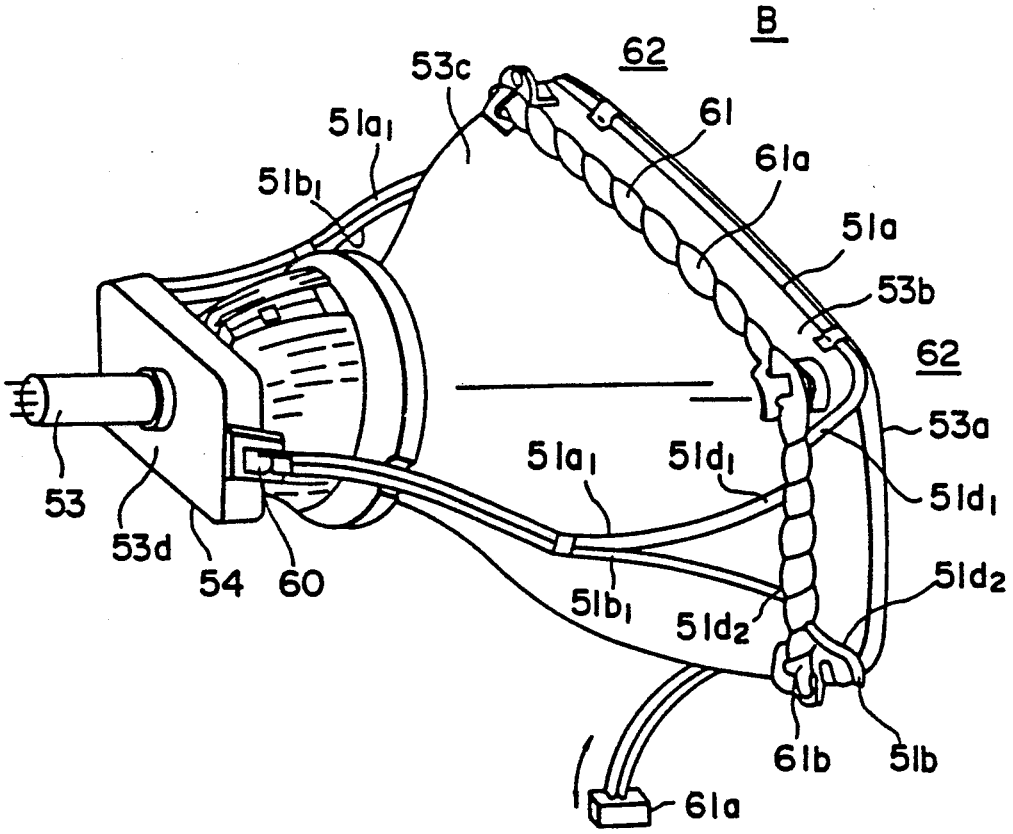
Figure 18:
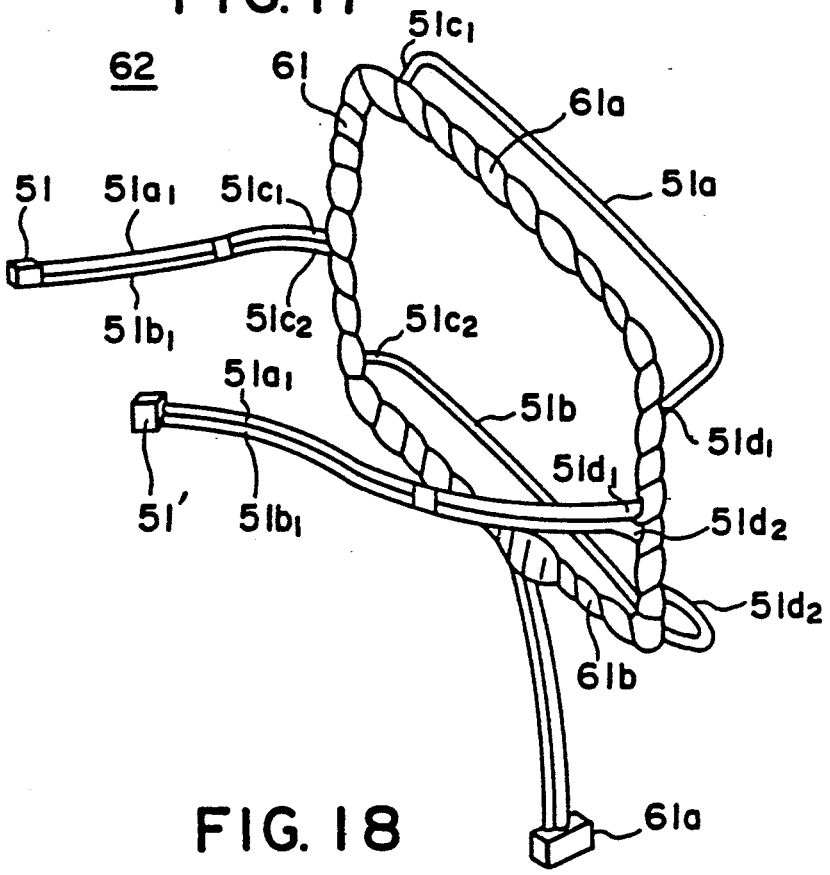
FIGS. 18 and 19 are perspective view showing devices of fourth and fifth embodiments according to this invention, respectively.

FIG. 16 is a perspective view showing the state where the device according to this invention shown in FIG. 18 which will be described later is attached to a cathode ray tube display apparatus, and FIG. 17 is a perspective view showing the state where the device according to this invention shown in FIG. 19 which will be described later is attached to a cathode ray tube display apparatus. The same components as those described above are designated by the same reference numerals, respectively, and their explanation will be omitted.

As shown in FIG. 16, the cathode ray tube display apparatus B is characterized in that a demagnetization coil 62 which will be described later is additionally provided in the arrangement of the above-described cathode ray tube display apparatus A.

Namely, as shown in FIGS. 16 and 8, the both ends of electric portions 51*a*, 51*b* for producing a magnetic flux for canceling the above-described leakage magnetic flux are attached, with a predetermined spacing therebetween, to the demagnetization coil 61 for demagnetizing magnetization, etc. of the shadow mask portion 53*e* attached on the funneled portion 53*c*. In order to cancel leakage magnetic flux $B_{2c}$ which is a portion of the main magnetic flux $B_{2a}$, as shown in FIG. 5 mentioned above, electric portions 51*a*, 51*b* are arranged on the left and right side surface portions $53_{b1}$, $53_{b2}$ of the face-plate portion 53*b* close to the fluorescent display screen surface 53*a* of the cathode ray tube 53, respectively. Then, lead portions $51_{a1}$, $51_{b1}$, $51_{a1}$, $51_{b1}$ contiguous thereto are conducted to the side surfaces 54*a*, 54*a* of the deflection yoke 54 substantially along the horizontal plane in the vicinity of the side walls 56, 56 of the cathode ray tube 53, and are fixed at predetermined positions (e.g., terminal portions 60, 60). A current is caused to flow in these lead wires in a direction shown in FIG. 10, thus to produce a magnetic flux $B_3$ in a direction of canceling the magnetic flux $B_{2c}$. Thus, leakage magnetic flux $B_{2c}$ leaking out, toward the outside, from the side walls 56, 56 of the cathode ray tube 53 and the side surfaces 54*a*, 54*a* of the deflection yoke 54 can be suppressed. Further, electric portions 51*a*, 51*b* are arranged on the upper and lower side edge portions $53_{b3}$,$53_{b4}$ of the face-plate portion 53*b* of the above-descried cathode ray tube 53 shown in FIG. 8. A current is caused to flow in these electric wires in a direction of the current shown in FIG. 8, to produce a magnetic flux $B_3$ for canceling the leakage magnetic flux $B_{2b}$, $B_1$. Thus, leakage magnetic flux $B_{2b}$, $B_1$ radiated from the fluorescent display screen surface 53*a* can be suppressed. The fourth embodiment of the device according to this invention is constructed as shown in FIG. 18. Reference numeral 61*a* denotes a connection appliance provided on the lead wire end of the demagnetization coil 61. Reference numerals 51, 51' denote connectors attached to the initial ends $51_{c1}$, $51_{c2}$ and the terminating ends $51_{d1}51_{d2}$ of the electric portions 51*a*, 51*b*, respectively. In place of using these connectors 51, 51', such electric wires may be soldered to respective predetermined portions.

Figure 19:
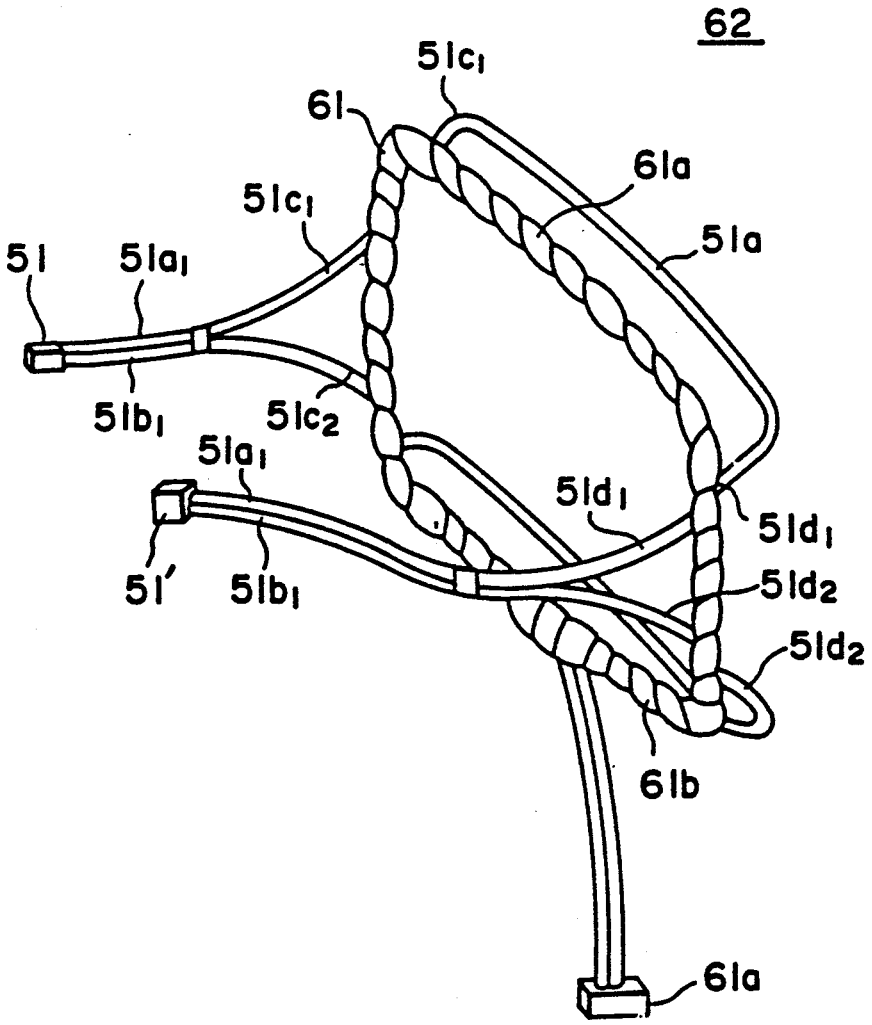

The fifth embodiment of the device according to this invention is constructed as shown in FIG. 19. This embodiment is substantially the same structure as that of the above-described fourth embodiment shown in FIG. 18, but differs from the fourth embodiment in that lead portions $51_{a1}$, $51_{b1}52_{a1}51_{b1}$ contiguous to the electric wires 51*a*, 51*b* are arranged in a manner that the spacing between two sets of lead portions is gradually widened according to these lead wires become close to the fluorescent display screen surface 53*a*.

As described above, this invention is not limited to the first to fifth embodiments, but include various implementations which can be considered to be identical in principle in the method of canceling leakage magnetic flux.

Figure 7C:
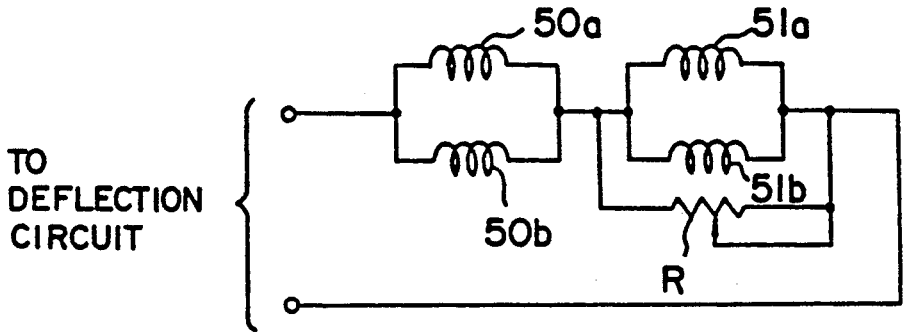
Figure 7D:
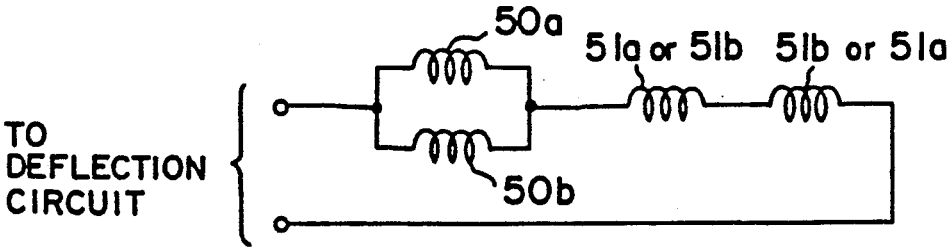

It is to be noted that while leakage magnetic flux from the deflection coil 54 varies depending upon the shape or deflection current of the cathode ray tube display apparatus, electric wires 51*a*, 51*b* may be connected in series with the both ends of the horizontal deflection coils 50*a*, 50*b* as shown in FIG. 7D, or they may be connected, as shown in FIGS. 7B and 7C, in parallel with electric wires 51*a*, 51*b* to which inductance L or resistance R is connected in parallel to adjust a current flowing therein, thus to balance such a leakage magnetic flux.

Figure 1A:
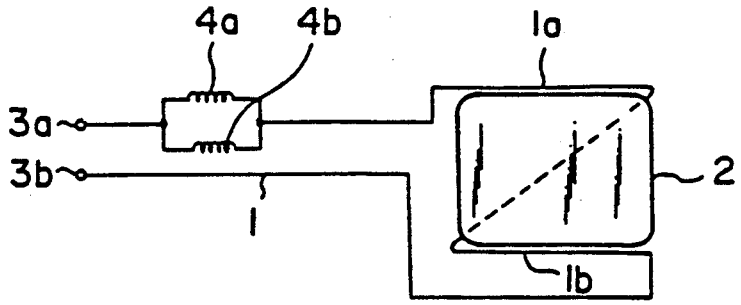
FIG. 1A PRIOR ART
FIGS. 1A and 1C and FIG. 2 are schematic diagrams and a perspective view showing the arrangement of the first and second prior arts, respectively.
Figure 1B:
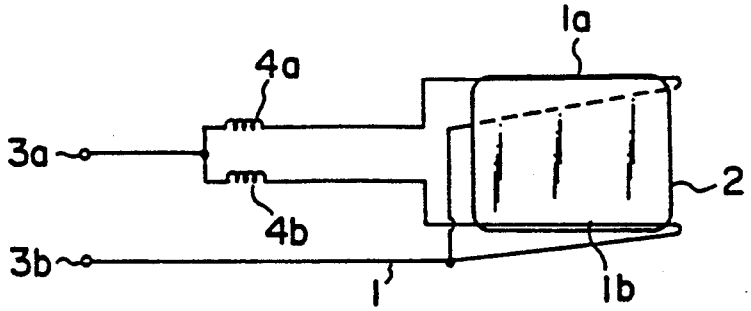
FIG. 1B PRIOR ART
Figure 1C:
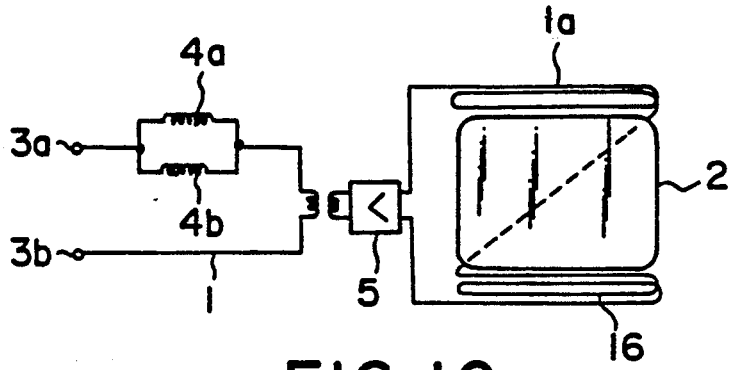
FIG. 1C PRIOR ART
Figure 2:
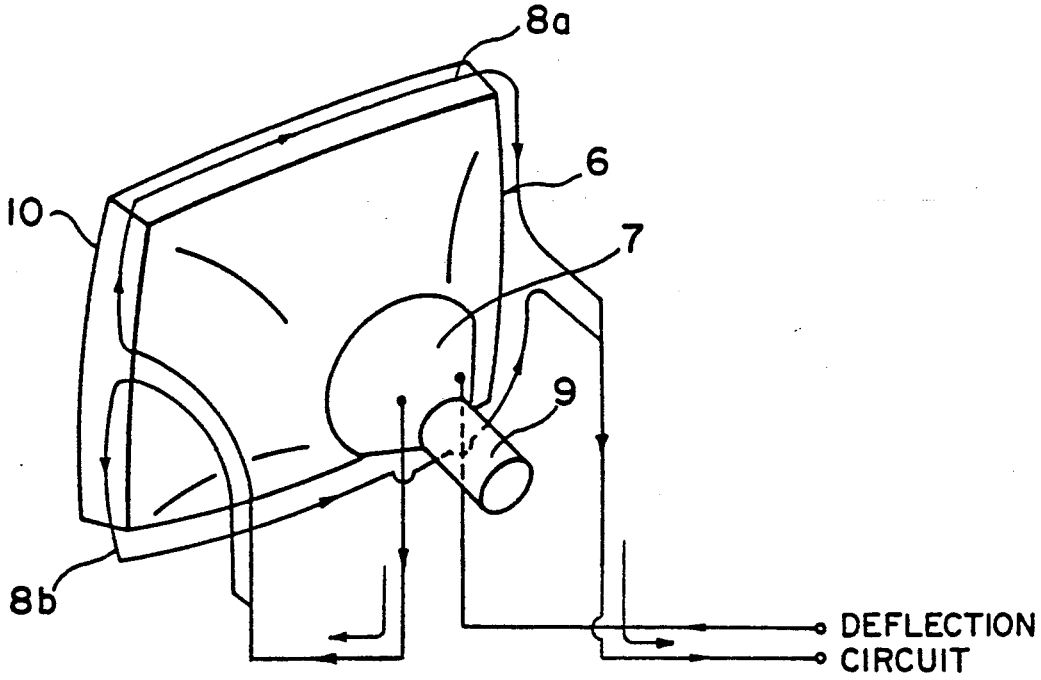
FIG. 2 PRIOR ART
Figure 3:
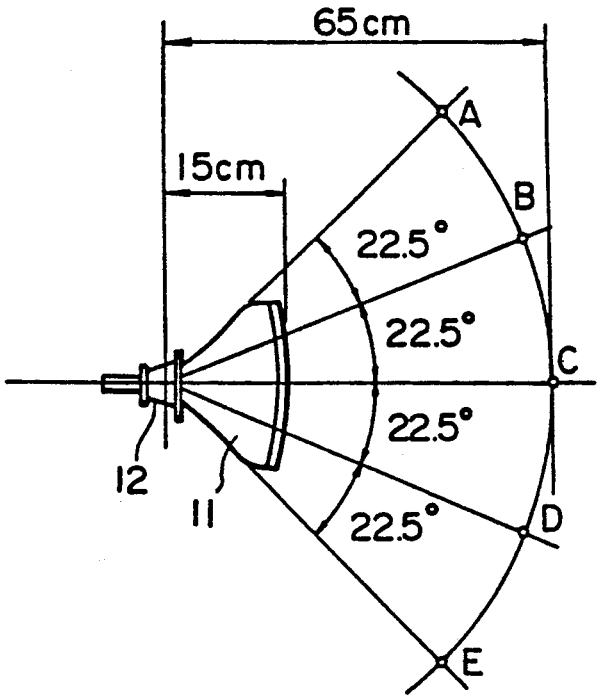
FIG. 3 PRIOR ART
FIGS. 3 and 4 are diagrams showing conventional measurement methods for measuring a low frequency leakage magnetic flux, respectively.
Figure 4:
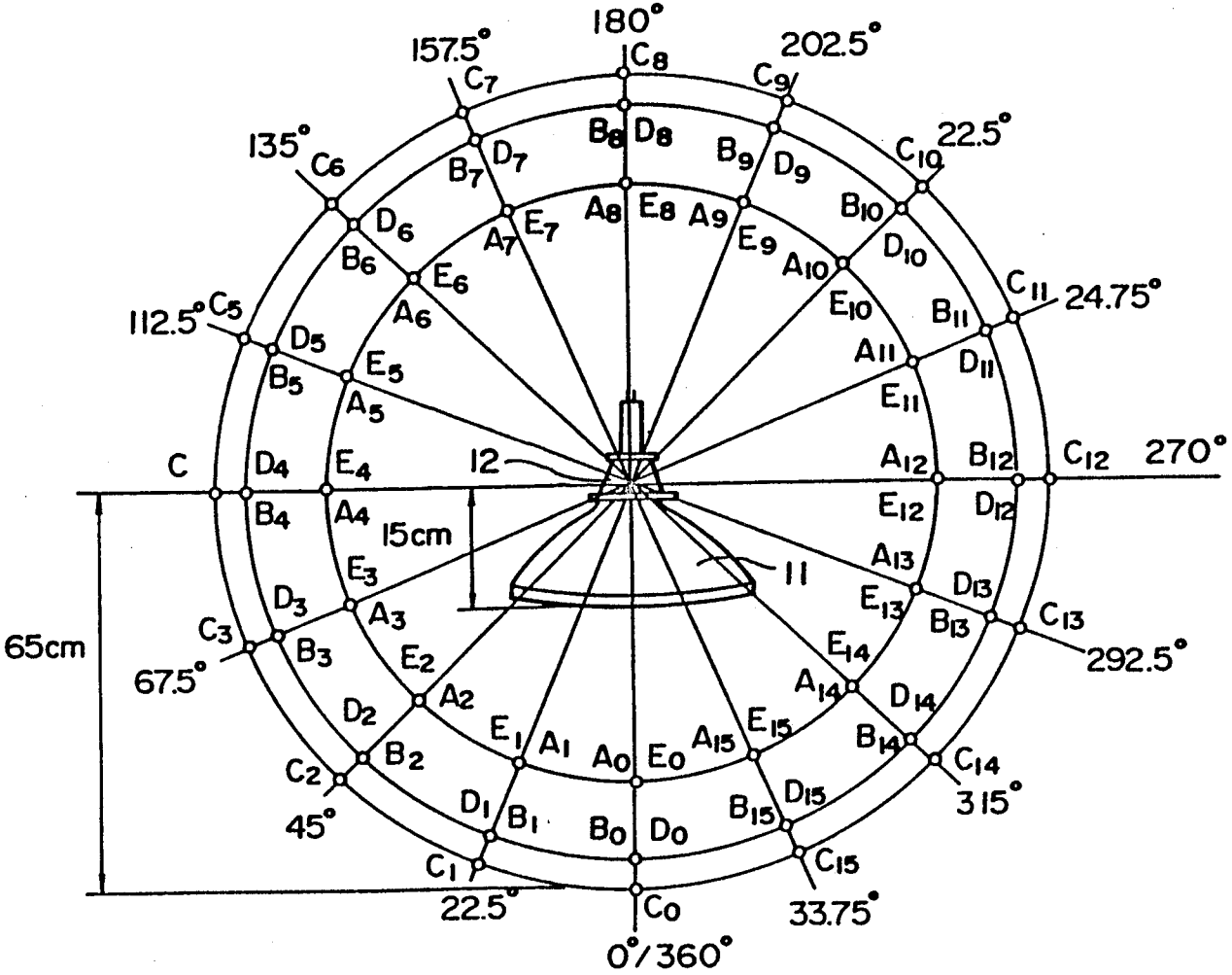
FIG. 4 PRIOR ART

For reference, values of leakage magnetic flux from the fluorescent display screen surface 53*a* in the case of the embodiments according to this invention shown in FIG. 6 and FIGS. 7A to 7D and in the case where this invention is not implemented (no measure is taken), which are measured at positions installed of the above-described antennas A0 to A15, B0 to B15, C0 to C15, D0 to D15, and E0 to E15 shown in FIGS. 3 and 4 are shown in the following Table.

As a result, it has been found that the method according to this invention advantageously permits the change rate and the strength of leakage magnetic flux to be reduced to about ⅓ to 1/7 of those of the method in which mo measure is taken.

TABLE

| POSITION OF ANTENNA | | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|---|
| ARTICLE IN WHICH NO MEASURE IS TAKEN EXAMPLE OF FIG. 13 | | | | | | | | | | | | | | | | | |
| A | mT/s | 55 | 55 | 55 | 57 | 58 | 58 | 58 | 58 | 58 | 57 | 60 | 58 | 58 | 56 | 56 | 56 |
| | nT | 118 | 118 | 119 | 122 | 123 | 122 | 122 | 120 | 121 | 119 | 122 | 123 | 122 | 121 | 121 | 117 |
| B | mT/s | 42 | 42 | 42 | 44 | 44 | 45 | 45 | 45 | 45 | 43 | 45 | 45 | 45 | 44 | 43 | 42 |
| | nT | 85 | 86 | 86 | 88 | 89 | 90 | 89 | 89 | 88 | 86 | 90 | 90 | 91 | 91 | 87 | 86 |
| C | mT/s | 40 | 40 | 40 | 41 | 40 | 39 | 38 | 38 | 37 | 38 | 39 | 40 | 41 | 41 | 40 | 40 |
| | nT | 62 | 63 | 63 | 64 | 62 | 60 | 58 | 56 | 56 | 56 | 60 | 62 | 64 | 64 | 63 | 63 |
| D | mT/s | 53 | 53 | 52 | 52 | 51 | 47 | 45 | 44 | 43 | 44 | 46 | 51 | 51 | 50 | 52 | 52 |
| | nT | 73 | 73 | 75 | 75 | 70 | 71 | 67 | 65 | 65 | 65 | 71 | 71 | 73 | 71 | 76 | 75 |
| E | mT/s | 73 | 75 | 70 | 73 | 71 | 67 | 66 | 64 | 66 | 67 | 69 | 69 | 70 | 69 | 72 | 72 |
| | nT | 110 | 112 | 108 | 106 | 104 | 100 | 97 | 95 | 96 | 97 | 102 | 103 | 106 | 106 | 107 | 109 |
| FIRST EMBODIMENT OF THIS INVENTION | | | | | | | | | | | | | | | | | |
| A | mT/s | 7 | 8 | 7 | 8 | 8 | 9 | 10 | 12 | 7 | 10 | 7 | 8 | 9 | 8 | 7 | 6 |
| | nT | 15 | 17 | 16 | 16 | 16 | 17 | 18 | 19 | 20 | 18 | 15 | 17 | 17 | 17 | 15 | 13 |
| B | mT/s | 6 | 7 | 9 | 7 | 8 | 7 | 8 | 11 | 12 | 10 | 9 | 8 | 7 | 6 | 7 | 7 |
| | nT | 13 | 15 | 16 | 17 | 16 | 16 | 17 | 19 | 20 | 17 | 16 | 15 | 15 | 14 | 11 | 11 |
| C | mT/s | 5 | 5 | 5 | 5 | 8 | 7 | 8 | 11 | 10 | 10 | 8 | 8 | 5 | 5 | 4 | 5 |
| | nT | 8 | 8 | 11 | 16 | 16 | 17 | 18 | 19 | 20 | 20 | 17 | 15 | 14 | 13 | 10 | 8 |
| D | mT/s | 10 | 8 | 6 | 6 | 8 | 10 | 11 | 10 | 12 | 9 | 8 | 7 | 6 | 6 | 6 | 8 |
| | nT | 17 | 15 | 13 | 16 | 17 | 18 | 20 | 22 | 21 | 20 | 17 | 15 | 14 | 14 | 14 | 15 |
| E | mT/s | 10 | 10 | 7 | 9 | 8 | 10 | 12 | 12 | 12 | 11 | 10 | 8 | 8 | 6 | 7 | 9 |
| | nT | 22 | 20 | 17 | 17 | 16 | 16 | 18 | 18 | 20 | 19 | 17 | 16 | 13 | 15 | 16 | 19 |

MEASUREMENT CONDITION:
HORIZONTAL DEFLECTION FREQUENCY 20.0 KHz
HORIZONTAL DEFLECTION CURRENT 7.8 A p-p

I claim:

1. A device for suppression of leakage of magnetic flux in a cathode ray tube display apparatus which comprises at least a cathode ray tube having a face plate with top and bottom rims and a side rim and a horizontal plane which horizontally crosses the face plate at a vertical center thereof and is approximately perpendicular to the face plate, and horizontal beam deflection means generating the leakage of magnetic flux, said deflection means comprising a pair of upper and lower coils each of which has a bent-up section producing a first magnetic field which deflects an electron beam of the cathode ray tube, and a second magnetic field produced as the leakage of magnetic flux, said first and second magnetic field forming a boundary plane therebetween so that two boundary planes are formed of said upper and lower deflection coils, respectively, said device comprising:

a pair of conductor means each of which has a main portion and two lead portions connected to the main portion, said main portion of the pair of conductor means being disposed substantially within said boundary plane and substantially along the top and bottom rims of the face plate, respectively, each of said lead portions of the pair of conductor means being rigidly mounted along a side wall of a funnel of the cathode ray tube so that one end of the lead portion is bent along the side rim of the face plate to couple with said main portion and another end of the lead portion extends directly and linearly toward a rear portion of said horizontal beam deflection means, each of said lead portions being arranged so as to establish an additional magnetic flux which contributes to the suppression of leakage of magnetic flux, and each of said lead portions progressively approaching said horizontal plane as the lead portion extends toward the rear of the horizontal beam deflection means, said pair of conductor means being driven with a current proportional to a horizontal deflection current flowing through said horizontal beam deflection means.

2. A device for suppression of leakage of magnetic flux in a cathode ray tube display apparatus which comprises at least a cathode ray tube having a face plate with top and bottom rims and a side rim, and a horizontal plane which horizontally crosses the face plate at a vertical center thereof and is approximately perpendicular to the face plate, and horizontal beam deflection means generating the leakage of magnetic flux, said deflection means comprising a pair of upper and lower coils each of which has a bent-up section producing a first magnetic field which deflects an electron beam of the cathode ray tube, and a second magnetic field produced as the leakage of magnetic flux, said first and second magnetic field forming a boundary plane therebetween so that the two boundary planes are formed of said upper and lower deflection coils, respectively, said device comprising:

a pair of conductor means each of which has a main portion and two lead portions connected to the main portion, said main portion of the pair of conductor means being disposed substantially within said boundary plane and substantially along the top and bottom rims of the face plate, respectively, each of said lead portions of the pair of conductor means being rigidly mounted along a side wall of a funnel of the cathode ray tube so that one end of the lead portion is bent along the side rim of the face plate to couple with said main portion and another end of the lead portion extends directly and linearly toward a rear portion of said horizontal beam deflection means, and said one end of the lead portion extending along a side rim of the face plate from a neighborhood of said horizontal plane to said top and bottom rims of the face plate to couple with said main portion of the pair of said conductor means, said lead portions being arranged so as to establish an additional magnetic flux which contributes to the suppression of leakage of magnetic flux, said pair of conductor means being driven with a current proportional to a horizontal deflection current flowing through said horizontal beam deflection means.

3. A device for suppression of leakage of magnetic flux in a cathode ray tube display apparatus which comprises at least a cathode ray tube having a face plate with top and bottom rims and a side rim and horizontal beam deflection means generating the leakage of magnetic flux, said deflection means comprising a pair of upper and lower coils each of which has a bent-up section producing a first magnetic field which deflects an electron beam of the cathode ray tube, and a second magnetic field produced as the leakage of magnetic flux, said first and second magnetic field forming a boundary plane therebetween, so that two boundary planes are formed of said upper and lower deflection coils, respectively, said device comprising:

a pair of conductor means being partially supported by demagnetizing means equipped to said cathode ray tube, each of which has a main portion and two lead portions connected to the main portion said main portion of the pair of conductor means being disposed substantially within said boundary plane and along substantially the top and bottom rims of the face plate, respectively, each of said lead portions of the pair of conductor means being rigidly mounted along a side wall of a funnel of the cathode ray tube in such a form that one end of the lead portion is bent along the side rim of the face plate to couple with said main portion and to couple with another end of the lead portion which extends directly and linearly toward a rear portion of said horizontal beam defection means, said lead portions being arranged so as to establish an additional magnetic flux which contributes to the suppression of leakage of magnetic flux, said pair of conductor means being driven with a current proportional to a horizontal deflection current flowing through said horizontal beam of deflection means.

4. In a device for suppression of leakage of magnetic flux in a cathode ray tube display apparatus including at least a carbon ray tube having a face plate with top and bottom rims and a side rim and a horizontal plane which horizontally crosses the face plate at a vertical center thereof and is approximately perpendicular to the face plate, and horizontal beam deflection means generating the leakage of magnetic flux, said deflection means comprising a pair of upper and lower coils each of which has a bent-up section producing a first magnetic field which deflects and electron beam of the cathode ray tube, and a second magnetic field produced as the leakage of magnetic flux, said first and second magnetic fields forming a boundary plane therebetween so that two boundary planes are formed of said upper and lower deflection coils, respectively, the improvement comprising:

a pair of conductor means each of which has a main portion and two lead portions connected to the main portion, said main portion of the pair of conductor means being disposed substantially within said boundary plane and substantially along the top and bottom rims of the face plate, respectively, each of said lead portions of the pair of conductor means being rigidly mounted along a side wall of a funnel of the cathode ray tube so that one end of the lead portion is bent along the side rim of the face plate to couple with said main portion and another end of the lead portion extends linearly and rearwardly toward a rear portion of said horizontal beam deflection means, and each of said lead portions progressively approaching said horizontal plane as the lead portion extends toward the rear of the horizontal beam deflection means, the lead portions of each of said conductor means being connected to said horizontal beam deflection means at a terminal of said horizontal beam deflection means, an angle being defined between the linearly extending lead portions of the conductor means, the magnitude of said angle being adjustable for regulating suppression of said leakage of magnetic flux, each of said lead portions being arranged so as to establish an additional magnetic flux which contributes to the suppression of leakage of magnetic flux, said pair of conductor means being driven with a current proportional to a horizontal deflection current flowing through said horizontal beam deflection means.

5. In a device for suppression of leakage of magnetic flux in a cathode ray tube display apparatus including at least a cathode ray tube having a face plate with top and bottom rims and a side rim circumscribing a fluorescent display screen surface, and a horizontal plane which horizontally crosses the face plate at a vertical center thereof and is approximately perpendicular to the face plate, said cathode ray tube further including a funnel portion extending rearward from said face plate, a shadow mask being attached to said funnel portion, and horizontal beam deflection means attached to said cathode ray tube at said funnel portion which generates leakage of magnetic flux, said deflection means comprising an upper coil and a lower coil each of which has a bent-up section producing a first magnetic field which deflects an electron beam of the cathode ray tube, and a second magnetic field produced as the leakage of magnetic flux, said first and second magnetic fields forming a boundary plane therebetween so that two boundary planes are formed of said upper and lower deflection coils, respectively, the improvement comprising:

a pair of conductor means each of which has a main portion and two lead portions connected to the main portion, said main portion of the pair of conductor means being disposed substantially within said boundary plane and substantially along the top and bottom rims of the face plate, respectively, proximate the fluorescent display screen surface, each of said lead portions of the pair of conductor means being rigidly mounted along a side wall of the funnel portion of the cathode ray tube so that one end of the lead portion is bent along the side rim of the face plate to coupled with said main portion and another end of the lead portion extends directly and linearly toward a rear portion of said horizontal beam deflection means, each of said lead portions being arranged so as to establish an additional magnetic flux which contributes to the suppression of leakage of magnetic flux, and each of said lead portions progressively approaching said horizontal plane as the lead portions extends toward the rear of the horizontal beam deflection means; and a demagnetization coil attached to and circumscribing the funnel portion of said cathode ray tube for demagnetizing said shadow mask, said demagnetization coil being connected to ends of the main portion and the lead portions of the pair of conductor means with a predetermined spacing separating points of connection of the ends of the main portions to the demagnetization coil.

6. In a device for suppression of leakage of magnetic flux in a cathode ray tube display apparatus including at least a cathode ray tube having a face plate with top and bottom rims and a side rim circumscribing a fluorescent display screen surface, and a horizontal plane which horizontally crosses the face plate at a vertical center thereof and is approximately perpendicular to the face plate, said cathode ray tube further including a funnel portion extending rearward from said face plate, a shadow mask being attached to said funnel portion, said horizontal beam deflection means attached to said cathode ray tube at said funnel portion which generates leakage of magnetic flux, said deflection means comprising an upper coil and a lower coil each of which has a bent-up section producing a first magnetic field which deflects an electron beam of the cathode ray tube, and a second magnetic field produced as the leakage of magnetic flux, said first and second magnetic fields forming a boundary plane therebetween so that two boundary planes are formed of said upper and lower deflection coils, respectively, the improvement comprising:

a pair of conductor means each of which has a main portion and two lead portions connected to the main portion, said main portion of the pair of conductor means being disposed substantially within said boundary plane and substantially along the top and bottom rims of the face plate, respectively, proximate the fluorescent display screen surface, each of said lead portions of the pair of conductor means being rigidly mounted along a side wall of the funnel portion of the cathode ray tube so that one end of the lead portion is bent along the side rim of the face plate to couple with said main portion and another end of the lead portion extends linearly toward a rear portion of said horizontal beam deflection means, the lead portion of each of said conductor means being mounted immediately adjacent to another of said lead portions along approximately half the distance from the horizontal beam deflection means to the side rims of the plate of the cathode ray tube and being spaced in a linearly and gradually increasing manner a remainder of the distance to the side rims of the face plate, each of said lead portions being arranged so as to establish an additional magnetic flux which contributes to the suppression of leakage of magnetic flux; and a demagnetization coil attached to and circumscribing the funnel proton of said cathode ray tube for demagnetizing said shadow mask, said demagnetization coil being connected to ends of the main portions and the lead portions of the pair of conductor means with a predetermined spacing separating points of connection of the ends of the main portions to the demagnetization coil.

7. In a device for suppression of leakage of magnetic flux in a cathode ray tube display apparatus including at least a cathode ray tube having a face plate with top and bottom rims and a side rim circumscribing a fluorescent display screen surface, and a horizontal plane which horizontally crosses the face plate at a vertical center thereof and is approximately perpendicular to the face plate, said cathode ray tube further including a funnel portion extending rearward from said face plate, a shadow mask being attached to said funnel portion, and horizontal beam deflection means attached to said cathode ray tube at said funnel portion which generates leakage of magnetic flux, said deflection means comprising an upper coil and a lower coil each of which has a bent-up section producing a first magnetic field which deflects an electron beam of the cathode ray tube, and a second magnetic field produced as the leakage of magnetic flux, said first and second magnetic fields forming a boundary plane therebetween so that two boundary planes are formed of said upper and lower deflection coils, respectively, the improvement comprising:

a pair of conductor means each of which has a main portion and two lead portions connected to the main portion, said main portion of the pair of conductor means being disposed substantially within said boundary plane and substantially along the top and bottom rims of the face plate, respectively, proximate the fluorescent display screen surface, each of said lead portions of the pair of conductor means being rigidly mounted along a side wall of the funnel portion of the cathode ray tue so that one end of the lead portion is bent along the side rim of the face plate to couple with said main portion and another end of the lead proton extends directly and linearly toward a rear portion of said horizontal beam deflection means, and each of said lead portions progressively approaching said horizontal plane as the lead portion extends toward the rear of the horizontal beam deflection means, said lead portions being arranged so as to establish an additional magnetic flux which contributes to suppression of the leakage of magnetic flux.

8. The apparatus as claimed in claim 7, including a demagnetization coil attached to and circumscribing the funnel portion of said cathode ray tube for demagnetizing said shadow mask, said demagnetization coil being connected to ends of the main portions and the lead portions of the pair of conductor means with a predetermined spacing separating points of connection of the ends of the main portions to the demagnetization coil.

9. A device for suppression of leakage of magnetic flux in a cathode ray tube display apparatus which comprises at least a cathode ray tube having a face plate with top and bottom rims and a side rim and a horizontal plane which horizontally crosses the face plate at a vertical center thereof and is approximately perpendicular to the face plate, and a horizontal beam deflection means generating the leakage of magnetic flux, said deflection means comprising a pair of upper and lower coils each of which has a bent-up section producing a first magnetic field which deflects an electron beam of the cathode ray tube, and a second magnetic field produced as the leakage of magnetic flux, said first and second magnetic field forming a boundary plane therebetween so that two boundary planes are formed of said upper and lower deflection coils, respectively, said device comprising:

upper and lower main conductor means, the upper main conductor means being mounted substantially within the boundary plane of the upper deflection coil and substantially along the top rims of the face plate, the lower main conductor means being mounted substantially within the boundary plane of the lower deflection coil and substantially along the bottom rims of the face plate;

a first lead conductor extending linearly in a downward and rearward direction from a first end of said upper main conductor means toward a rear portion of said horizontal beam deflection means, said first lead conductor progressively approaching said horizontal plane as said first lead conductor nears said horizontal beam deflection means;

a second lead conductor extending linearly in a downward and rearward direction from an opposite end of said upper main conductor means, said second lead conductor being parallel to said first lead conductor and progressively approaching said horizontal plane as said second lead conductor nears said horizontal beam deflection means;

a third lead conductor extending linearly in an upward and rearward direction from a first end of said lower main conductor means toward a rear portion of said horizontal beam deflection means, said third lead conductor progressively approaching said horizontal plane as said third lead conductor nears said horizontal beam deflection means; and a fourth lead conductor extending linearly in a upward and rearward direction from an opposite end of said lower main conductor means, said fourth lead conductor being parallel to said third lead conductor and progressively approaching said horizontal plane as said fourth lead conductor nears said horizontal beam deflection means;

wherein said first, second, third and fourth lead conductors are rigidly but adjustably arranged with respect to one another so that each establishes an additional magnetic flux which contributes to the suppression of said leakage of magnetic flux.

* * * * *